US008126410B2

(12) United States Patent
Alon et al.

(10) Patent No.: US 8,126,410 B2
(45) Date of Patent: Feb. 28, 2012

(54) MINIATURE SUB-RESONANT MULTI-BAND VHF-UHF ANTENNA

(75) Inventors: Dani Alon, Hod Hasharon (IL); David Ben-Bassat, Yehud (IL)

(73) Assignee: Vishay Intertechnology, Inc., Malvern, PA (US)

( * ) Notice: Subject to any disclaimer, the term of this patent is extended or adjusted under 35 U.S.C. 154(b) by 918 days.

(21) Appl. No.: 12/134,467

(22) Filed: Jun. 6, 2008

(65) Prior Publication Data

US 2008/0305750 A1 Dec. 11, 2008

Related U.S. Application Data

(60) Provisional application No. 60/942,544, filed on Jun. 7, 2007.

(51) Int. Cl.
*H04C 1/52* (2006.01)

(52) U.S. Cl. ..... 455/107; 455/193.1; 455/13.3; 455/19; 343/702

(58) Field of Classification Search ..... 455/107, 455/193.1, 13.3, 19, 82, 83, 121, 562.1, 575.7, 455/197.2; 343/702, 895, 725
See application file for complete search history.

(56) References Cited

U.S. PATENT DOCUMENTS

| | | | | |
|---|---|---|---|---|
| 3,414,833 | A | 12/1968 | Tolliver | |
| 3,611,154 | A | 10/1971 | Kupfer | |
| 4,486,722 | A | 12/1984 | Landt | |
| 4,564,843 | A | 1/1986 | Cooper | |
| 4,701,732 | A | 10/1987 | Nestlerode | |
| 4,806,944 | A | 2/1989 | Jacomb-Hood | |
| 4,939,525 | A | 7/1990 | Brunner | |
| 5,065,121 | A | 11/1991 | Ghadaksaz | |
| 5,870,066 | A | 2/1999 | Asakura et al. | |
| 5,872,489 | A | 2/1999 | Chang et al. | |
| 5,943,016 | A | 8/1999 | Snyder, Jr. et al. | |
| 5,969,673 | A * | 10/1999 | Bickley et al. | 342/357.59 |
| 6,061,031 | A | 5/2000 | Cosenza et al. | |
| 6,064,351 | A | 5/2000 | Mandai et al. | |
| 6,169,523 | B1 | 1/2001 | Ploussios | |
| 6,501,427 | B1 | 12/2002 | Lilly et al. | |

(Continued)

FOREIGN PATENT DOCUMENTS

JP 09-035942 2/1997

(Continued)

*Primary Examiner* — Minh D Dao

(74) *Attorney, Agent, or Firm* — Howard Zaretsky; Woods Oviatt Gilman LLP

(57) ABSTRACT

A novel antenna system for receiving transmissions in the VHF and UHF frequency bands particularly suitable as a miniaturized antenna for UHF reception, such as of digital video broadcasting transmissions. The antenna system utilizes a combination of three techniques including (1) the use of dialect loading using a high dielectric constant ceramic substrate; (2) an antenna dielectrically loaded and tuned to a significantly higher frequency than desired; and (3) use of a tuning circuit to compensate for the frequency offset of the antenna thereby shifting the resonant frequency to cover the entire band. The antenna is intentionally designed to be too small to radiate at the frequency of interest. The antenna element is then 'forced' to be tuned to the desired lower frequency using passive (or active) reactive components as part of a tuning circuit. Multi-band operation is achieved by providing a bypass switch to connect the antenna element either to (1) a first receiver without the tuning circuit (i.e. high frequency tuning) or (2) a second receiver with the tuning circuit (i.e. low frequency tuning).

44 Claims, 14 Drawing Sheets

U.S. PATENT DOCUMENTS

| | | | | |
|---|---|---|---|---|
| 6,624,795 | B2 * | 9/2003 | Boyle | 343/895 |
| 6,765,536 | B2 | 7/2004 | Phillips et al. | |
| 6,819,290 | B2 * | 11/2004 | Hani et al. | 343/700 MS |
| 6,828,941 | B2 | 12/2004 | King et al. | |
| 6,897,830 | B2 * | 5/2005 | Bae et al. | 343/895 |
| 7,034,760 | B2 | 4/2006 | Nakamura | |
| 7,088,299 | B2 * | 8/2006 | Siegler et al. | 343/745 |
| 7,136,021 | B2 * | 11/2006 | Huang et al. | 343/702 |
| 7,180,452 | B2 * | 2/2007 | Saito | 343/702 |
| 7,212,789 | B2 * | 5/2007 | Kuffner | 455/83 |
| 7,277,055 | B2 * | 10/2007 | Tamaoka | 343/700 MS |
| 7,317,901 | B2 * | 1/2008 | Navsariwala et al. | 455/82 |
| 7,369,828 | B2 * | 5/2008 | Shamsaifar | 455/193.1 |
| 7,450,076 | B1 * | 11/2008 | Lin et al. | 343/702 |
| 2003/0096583 | A1 | 5/2003 | Watanabe | |
| 2003/0146876 | A1 * | 8/2003 | Greer et al. | 343/702 |
| 2004/0201527 | A1 * | 10/2004 | Hani et al. | 343/702 |
| 2004/0233109 | A1 * | 11/2004 | Ying et al. | 343/700 MS |
| 2004/0233115 | A1 * | 11/2004 | Caimi et al. | 343/741 |
| 2005/0009472 | A1 * | 1/2005 | Shamsaifar | 455/77 |
| 2005/0116869 | A1 * | 6/2005 | Siegler et al. | 343/749 |
| 2005/0134508 | A1 | 6/2005 | Ueda | |
| 2005/0225499 | A1 | 10/2005 | Kingsley et al. | |
| 2006/0063499 | A1 | 3/2006 | Miyagi | |
| 2007/0216590 | A1 | 9/2007 | Montgomery et al. | |
| 2008/0036675 | A1 | 2/2008 | Fujieda | |
| 2010/0060531 | A1 * | 3/2010 | Rappaport | 343/702 |
| 2010/0207823 | A1 * | 8/2010 | Sakata et al. | 343/702 |

FOREIGN PATENT DOCUMENTS

| | | |
|---|---|---|
| KR | 10-2003-0057848 | 7/2003 |
| KR | 10-2006-0010634 | 2/2006 |
| WO | WO/98/03446 | 1/1998 |

* cited by examiner

MINIATURE SUB-RESONANT MULTI-BAND VHF-UHF ANTENNA

REFERENCE TO PRIORITY APPLICATION

This application claims priority to U.S. Provisional Application Ser. No. 60/942,544, filed Jun. 7, 2007, entitled "Antenna system for UHF frequency band," incorporated herein by reference in its entirety.

FIELD OF THE INVENTION

The present invention relates generally to antenna circuits and systems and more particularly relates to a miniature sub-resonant multi-band antenna system for the VHF-UHF frequency hand.

BACKGROUND OF THE INVENTION

As the use of computers and especially handheld or mobile electronic devices continues to increase at a rapid rate, the demand for peripherals and systems connected via wireless connections continues to increase. The number of wireless applications is currently increasing at a very high rate in areas such as security alarms, networking, personal computing, data communications, telephony and computer security.

Wireless communications currently may take many forms such as ultrasonic, IR and RF. In the case of RF communications, wireless transmitters, receivers and transceivers use one or more antenna elements to convert an electrical RF signal to and from an electro-magnetic wave. During transmission, the antenna serves as a radiator, generating the electromagnetic wave. During reception, the antenna serves as an absorber, receiving the electromagnetic wave.

An antenna is a transducer designed to transmit and/or receive radio waves which are a class of electromagnetic waves. Antennas function to convert RF electrical currents into electromagnetic waves and to convert electromagnetic waves into RF currents. Antennas are used in systems such as radio and television broadcasting, point-to-point radio communication, Wireless Local Area Network (WLAN), Broadband Wireless Access (BWA), radar, and space exploration.

An antenna typically comprises an arrangement of electrical conductors that generate a radiating electromagnetic field in response to an applied alternating voltage and the associated alternating electric current. When placed in an electromagnetic field, the field induces an alternating current in the antenna and a voltage is generated between its terminals.

An antenna is an electrical element having defined resonance frequencies and bandwidth. The resonant frequency of an antenna is related to the electrical length of the antenna (i.e. the physical length of the wire divided by its velocity factor). Typically, an antenna is tuned for a specific frequency and is effective for a range of frequencies usually centered around the resonant frequency. Other properties of the antenna (especially radiation pattern and impedance), however, change with frequency.

Communication and computing device manufacturers face an ongoing challenge to miniaturize electronic components. This challenge also applies to antenna design where the antenna's physical dimensions are strongly linked to the component's performance. As the physical size of communication devices shrink, manufacturers are compelled to shrink the size of the antenna systems as well.

One such area where component miniaturization is crucial is digital video broadcasting. Digital Video Broadcasting-Terrestrial (DVB-T) is the standard for the broadcast transmission of digital terrestrial television. This system transmits a compressed digital audio/video stream, using OFDM modulation with concatenated channel coding (i.e. COFDM). DVB-T is being adopted primarily for digital television broadcasting. Using OFDM, the wide-band digital signal is split into a large number of slower digital streams which are all transmitted on a set of closely spaced adjacent carrier frequencies.

Digital Video Broadcasting-Handheld (DVB-H) is a mobile TV format specification for bringing broadcast services to mobile handsets. DVB-H technology is a superset of the DVB-T system for digital terrestrial television, with additional features to meet the specific requirements of handheld, battery-powered receivers.

MediaFLO (forward link only) is a technology introduced by Qualcomm to broadcast data to portable devices such as cell phones and PDAs. Broadcast data can include multiple real-time audio and video streams, individual, non-real time video and audio "clips", as well as IP Datacast application data such as stock market quotes, sports scores, and weather reports. The data transmission path in MediaFLO is one-way, from the tower to the device. The MediaFLO system transmits data on a frequency separate from the frequencies used by current cellular networks. In the United States, the MediaFLO system will use frequency spectrum 716-722 MHz, which was previously allocated to UHF TV Channel 55.

Additional digital video standards include, for example, the Korean T-DMB standard and the European DVB-H standard.

Ultra-High Frequency (UHF) is a frequency band used primarily for television broadcasts between approximately 474 MHz and 862 MHz. Very-High Frequency (VHF) is a lower band between approximately 200 and 300 MHz. Up until recently, most UHF television transmissions were analog (i.e. the ubiquitous high gain Yagi roof antennas or "rabbit ears" antennas) until satellite (also rabbit ears). Both transmission and reception were stationary, allowing a user to point the antenna towards the nearest transmitter and obtain a relatively good link. Analog transmissions, however, will soon be obsolete in February 2009 in the United States. The old analog transmissions are being replaced with digital broadcasting due to spectrum crowding caused by the fact that analog transmissions are not efficient in frequency.

Typically, an antenna is designed for a certain band of frequencies. The antenna is related to the wavelength of radiation the antenna is supposed to receive. A fairly efficient antenna can be constructed with $\lambda/2$. A monopole type of antenna at $\lambda/4$ is less efficient but operative. The $\lambda/4$ antennas are the most prevalent type used in handheld devices such as mobile communication devices, e.g., cell phones. Full $\lambda$ antennas are not practical since they are too long at the frequencies of interest. For example, the length of a 30 MHz one $\lambda$ antenna is 10 meters.

It would therefore be desirable to have an antenna system that is capable of covering the desired frequency band while having minimal physical dimensions. The miniaturized antenna preferably covers multiple frequency bands without requiring an increase in physical size.

SUMMARY OF THE INVENTION

The present invention is a novel antenna system for receiving transmissions in the VHF and UHF frequency bands that overcomes the disadvantages and drawbacks of prior art antenna systems. The antenna system of the present invention is particularly suitable to provide a miniaturized antenna for UHF reception in mobile devices. The miniature antenna system of the present invention enables the implementation of low cost, small form factor mobile devices such as those designed to receive digital video broadcasting transmissions.

To achieve the desired band coverage and small size, the antenna system of the present invention utilizes a combination of the following three techniques: (1) the use of dialect loading using a high dielectric constant ceramic substrate; (2) a sub-resonant designed antenna, i.e. an antenna dielectrically loaded and tuned to a significantly higher frequency than desired (or to a frequency at the upper end of the desired frequency band); and (3) use of a tuning circuit that is programmable to permit coverage of the entire desired frequency band (e.g., VHF or UHF band) wherein the tuning circuit compensates for the frequency offset of the antenna thereby shifting the resonant frequency to cover the entire UHF band.

Thus, the antenna element is designed to radiate at a higher frequency than desired. The antenna is intentionally designed to be too small to radiate at the frequency of interest. The antenna element is 'forced' to be tuned to the desired lower frequency using passive (or active) reactive components as part of a tuning circuit. A disadvantage is that the antenna efficiency is reduced. Thus, there is a tradeoff between antenna size and efficiency.

The antenna system also provides optional multi-band operation. In multi-band operation, the antenna can be tuned to at least two different frequency bands utilizing a bypass switch to switch between bands. Since the antenna element is already tuned to a higher resonant frequency that desired, a switch is operative to connect the antenna element either to (1) a first receiver without the tuning circuit (i.e. high frequency tuning) or (2) a second receiver with the tuning circuit (i.e. low frequency tuning).

One application of the antenna system of the invention is in mobile and handheld devices such as PDAs, cell phones, etc. The antenna tuning circuits of the present invention can be used in reception/transmission of the cellular signal, FM receiver circuits, television signal receiver circuits, GPS receiver circuits or any other receive mode application (i.e. transceiver or receive only).

The use of the antenna system of the present invention provides numerous advantages, including the following: (1) the ability to cover the entire desired frequency band (e.g., VHF, UHF, L-band, etc.); (2) miniature size physical dimensions allowing the antenna system to fit into small form factor wireless mobile devices; and (3) the ability to tune to multiple frequency bands utilizing a bypass switch and appropriate antenna element and tuning circuit design.

Note that some aspects of the invention described herein may be constructed as soft core realized HDL circuits embodied in an Application Specific Integrated Circuit (ASIC), Field Programmable Gate Array (FPGA) or other integrated circuit (IC), or as functionally equivalent discrete hardware components.

There is thus provided in accordance with the invention, an antenna providing a tunable range in a desired frequency band, the antenna comprising an antenna element comprising a radiating structure disposed on a substrate made of a dielectric ceramic material that provides dielectric loading of the radiating structure, wherein the resonant frequency of the antenna element is higher than the desired band of frequencies and a variable reactance tuning circuit electrically coupled to the antenna element, the tuning circuit operative to lower the resonant frequency of the antenna element to a frequency within the desired frequency band.

There is also provided in accordance with the invention, a method of designing an antenna tunable over a desired frequency band, the method comprising the steps of providing an antenna element comprising a radiating structure disposed on a substrate made of a dielectric material operative to provide dielectric loading of the radiating structure, tuning the antenna element to achieve a resonant frequency substantially higher than desired and compensating for the mistuned antenna element by providing a variable reactance tuning circuit electrically coupled to the antenna element to tune the antenna element to a frequency within the desired frequency band.

There is further provided in accordance with the invention, a multi-band antenna comprising an antenna element comprising a radiating structure disposed on a substrate made of a dielectric material that provides dielectric loading of the radiating structure, wherein the antenna element is operative to resonate at a first frequency in a high frequency band, a variable reactance tuning circuit electrically coupled to the antenna element, the tuning circuit operative to lower the resonant frequency of the antenna element to a second frequency in a low frequency band and a switch electrically coupled to the antenna element and the tuning circuit, the switch operative to bypass the tuning circuit thereby permitting the antenna element to resonate at the first frequency in the high frequency band.

There is also provided in accordance with the invention, a method of designing a multi-band antenna, the method comprising the steps of providing an antenna element comprising a radiating structure disposed on a substrate made of a dielectric material operative to provide dielectric loading of the radiating structure, providing a tuning circuit electrically coupled to the antenna element and operative to tune the antenna element to achieve a resonant frequency in a high frequency band, compensating for the mistuned antenna element by providing a variable reactance tuning circuit electrically coupled to the antenna element to lower the resonate frequency of the antenna element to a frequency in a low frequency band and providing a switch electrically connected to the antenna element and the tuning circuit, the switch operative to bypass the tuning circuit thereby allowing the antenna element to resonate at the resonant frequency in the high frequency band.

There is further provided in accordance with the invention, an antenna providing a tunable range in a desired frequency band, the antenna comprising an antenna element comprising a radiating structure disposed on a substrate made of a dielectric material that provides dielectric loading of the radiating structure, wherein the resonant frequency of the antenna element is at the upper end of the desired band of frequencies and a variable reactance tuning circuit electrically coupled to the antenna element, the tuning circuit operative to lower the resonant frequency of the antenna element to a frequency lower than the resonant frequency.

There is also provided in accordance with the invention, a mobile communications device comprising a transceiver operative to receive and transmit transmissions to and from a base station, a second radio operative to receive a signal in a desired frequency band from an antenna system electrically coupled thereto, the antenna system comprising an antenna element comprising a radiating structure disposed on a substrate made of a dielectric material that provides dielectric loading of the radiating structure, wherein the resonant frequency of the antenna element is substantially higher than the desired band of frequencies, a variable reactance tuning circuit electrically coupled to the antenna element, the tuning circuit operative to lower the resonant frequency of the antenna element to a frequency within the desired frequency band and a processor operative to receive data from the second radio and to send and receive data to and from the transceiver.

There is further provided in accordance with the invention, an antenna system comprising a dielectrically loaded antenna element tuned to a first frequency significantly higher than desired and a tuning circuit electrically coupled to the antenna element and operative to compensate for a frequency offset of the antenna element thereby shifting the resonant frequency of the antenna element to cover a desired lower frequency band.

BRIEF DESCRIPTION OF THE DRAWINGS

The invention is herein described, by way of example only, with reference to the accompanying drawings, wherein.

DETAILED DESCRIPTION OF THE INVENTION

Notation Used Throughout

Figure 1:
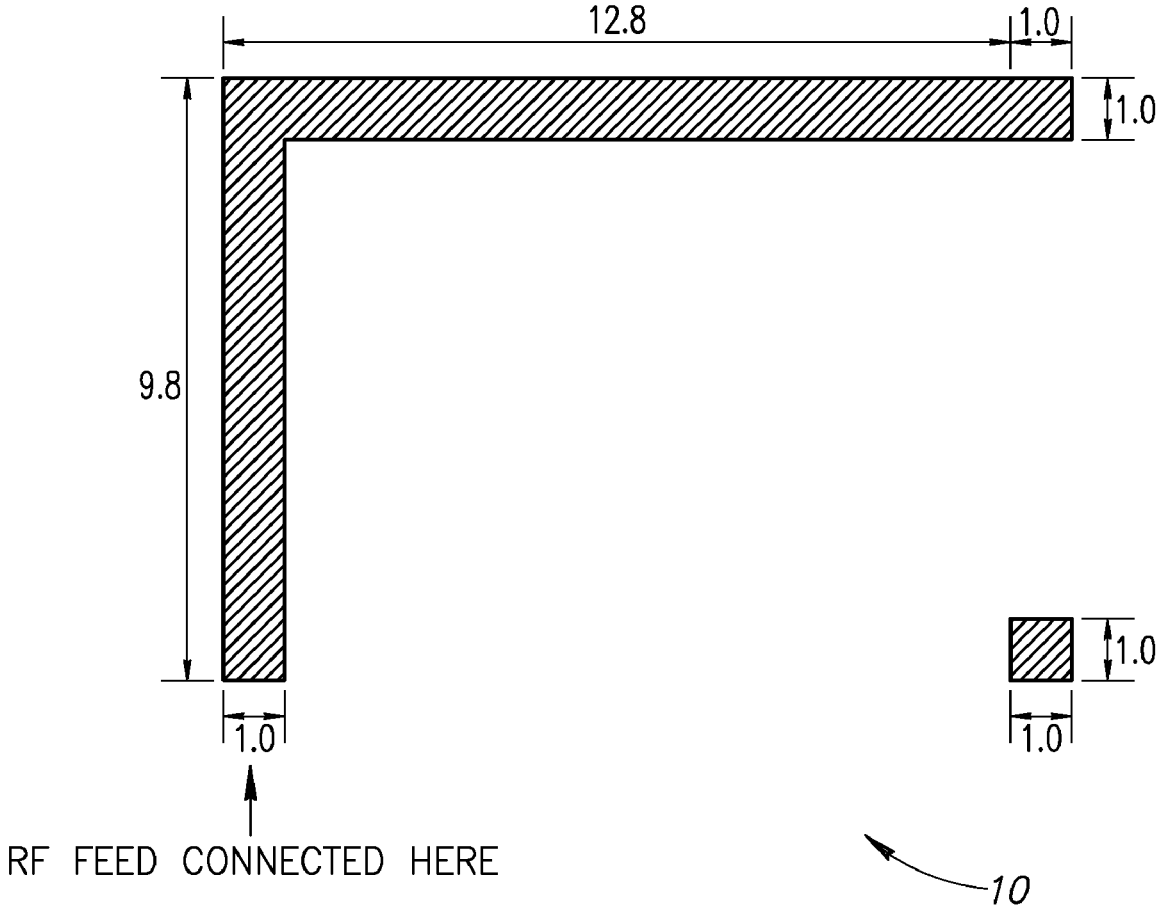
FIG. 1 is a diagram illustrating the footprint and mechanical dimensions of an example antenna element.

The following notation is used throughout this document.

| Term | Definition |
|---|---|
| AC | Alternating Current |
| ASIC | Application Specific Integrated Circuit |
| AVI | Audio Video Interleave |
| BMP | Windows Bitmap |
| BWA | Broadband Wireless Access |
| COFDM | Coded OFDM |
| CPU | Central Processing Unit |
| DC | Direct Current |
| DE | Dielectric Losses |
| DSL | Digital Subscriber Line |
| DVB-H | Digital Video Broadcasting-Handheld |
| DVB-T | Digital Video Broadcasting-Terrestrial |
| EDGE | Enhanced Data Rates for GSM Evolution |
| FM | Frequency Modulation |
| FPGA | Field Programmable Gate Array |
| GPRS | General Packet Radio Service |
| GPS | Global Positioning System |
| GSM | Global System for Mobile communications |
| IC | Integrated Circuit |
| IEEE | Institute of Electrical and Electronics Engineers |
| IR | Infrared |
| JPG | Joint Photographic Experts Group |
| LAN | Local Area Network |
| MBOA | Multiband OFDM Alliance |
| MBRAI | Mobile and Portable DVB-T/H Radio Access Interface |
| MP3 | MPEG-1 Audio Layer 3 |
| MPG | Moving Picture Experts Group |
| OFDM | Orthogonal Frequency Division Multiplexing |
| OFDM | Orthogonal Frequency Division Multiplexing |
| PC | Personal Computer |
| PCB | Printed Circuit Board |
| PCI | Peripheral Component Interconnect |
| PDA | Portable Digital Assistant |
| RAM | Random Access Memory |
| RAT | Radio Access Technology |
| RF | Radio Frequency |
| ROM | Read Only Memory |
| SIM | Subscriber Identity Module |
| SoC | System on Chip |
| TV | Television |
| UHF | Ultra-High Frequency |
| USB | Universal Serial Bus |
| UWB | Ultra Wideband |
| VHF | Very-High Frequency |
| WiFi | Wireless Fidelity |
| WiMAX | Worldwide Interoperability for Microwave Access |
| WiMedia | Radio platform for UWB |
| WLAN | Wireless Local Area Network |
| WMA | Windows Media Audio |
| WMV | Windows Media Video |
| WPAN | Wireless Personal Area Network |

DETAILED DESCRIPTION OF THE INVENTION

The present invention is a novel antenna system for receiving transmissions in the VHF and UHF frequency bands that overcomes the disadvantages and drawbacks of prior art antenna systems. The antenna system of the present invention is particularly suitable to provide a miniaturized antenna for UHF reception in mobile devices. The miniature antenna system of the present invention enables the implementation of low cost, small form factor mobile devices such as those designed to receive digital video broadcasting transmissions.

To achieve the desired band coverage and small size, the antenna system of the present invention utilizes a combination of the following three techniques: (1) the use of dielectric loading using a high dielectric constant ceramic substrate; (2) a sub-resonant designed antenna, i.e. an antenna dielectrically loaded and tuned to a significantly higher frequency than desired; and (3) use of a tuning circuit that is programmable to permit coverage of the entire desired frequency band (e.g., VHF or UHF band) wherein the tuning circuit compensates for the frequency offset of the antenna thereby shifting the resonant frequency to cover the entire UHF band.

Thus, the antenna element is designed to radiate at a higher frequency than desired. The antenna is intentionally designed to be too small to radiate at the frequency of interest. The antenna element is 'forced' to be tuned to the desired lower frequency using passive (or active) reactive components as part of a tuning circuit. A disadvantage is that the antenna efficiency is reduced. Thus, there is a tradeoff between antenna size and efficiency.

The antenna system also provides optional multi-band operation. In multi-band operation, the antenna can be tuned to at least two different frequency bands utilizing a bypass switch to switch between bands. Since the antenna element is already tuned to a higher resonant frequency that desired, a switch is operative to connect the antenna element either to (1) a first receiver without the tuning circuit (i.e. high frequency tuning) or (2) a second receiver with the tuning circuit (i.e. low frequency tuning).

One application of the antenna system of the invention is in mobile and handheld devices such as PDAs, cell phones, etc. The antenna tuning circuits of the present invention can be used in reception/transmission of the cellular signal, FM receiver circuits, television signal receiver circuits, GPS receiver circuits or any other receive mode application (i.e. transceiver or receive only).

Although the multi-band antenna system of the present invention can be incorporated in numerous types of wireless communication devices such a multimedia player, cellular phone, PDA, DSL modem, WPAN device, etc., the example application presented is in the context of a mobile communication device. It is not intended, however, that the invention will be limited to the example applications and embodiments presented. It is appreciated that one skilled in the art can apply the principles of the present invention to many other types of communication systems well-known in the art without departing from the spirit and scope of the invention. In addition, the principles of the invention can be applied to other wireless or wired standards and is applicable wherever there is a need to provide a miniaturized antenna in the VHF or UHF frequency bands.

Note that throughout this document, the term communications device is defined as any apparatus or mechanism adapted to transmit, receive or transmit and receive data through a medium. The term communications transceiver or communications device is defined as any apparatus or mechanism adapted to transmit and receive data through a medium. The communications device or communications transceiver may be adapted to communicate over any suitable medium, including wireless or wired media. Examples of wireless media include RF, infrared, optical, microwave, UWB, Bluetooth, WiMAX, WiMedia, WiFi, or any other broadband medium, etc. Examples of wired media include twisted pair, coaxial, optical fiber, any wired interface (e.g., USB, Firewire, Ethernet, etc.). The term Ethernet network is defined as a network compatible with any of the IEEE 802.3 Ethernet standards, including but not limited to 10Base-T, 100Base-T or 1000Base-T over shielded or unshielded twisted pair wiring. The terms communications channel, link and cable are used interchangeably.

The term multimedia player or device is defined as any apparatus having a display screen and user input means that is capable of playing audio (e.g., MP3, WMA, etc.), video (AVI, MPG, WMV, etc.) and/or pictures (JPG, BMP, etc.). The user input means is typically formed of one or more manually operated switches, buttons, wheels or other user input means. Examples of multimedia devices include pocket sized personal digital assistants (PDAs), personal media player/recorders, cellular telephones, handheld devices, and the like.

The term antenna element is intended to refer to the actual radiating element that is capable of receiving electromagnetic radiation and generating an electrical signal therefrom. It does not necessarily also include a tuning circuit which is typically separate from the antenna element. In one embodiment, the antenna element comprises a chip antenna.

It is noted that the majority of conventional antennas include distributed elements as part of their design, such as stubs and traces that function to tune the antenna. These types of tuning elements are considered distributed elements while the elements of the tuning circuit of the present invention are considered lumped elements. For example, the elements making up the tuning circuit of the present invention may comprise discrete components (i.e. inductors, capacitors) constructed on a PCB assembly.

Antenna System

The present invention is a miniature multi-band antenna system suitable for receiving/transmitting electromagnetic radiation in the VHF and UHF frequency bands. The antenna system comprises both single band and multi-band embodiments. The single band embodiment is applicable, for example, to the VHF and UHF frequency bands. The multi-band embodiment is applicable, for example, to the VHF, UHF and L frequency bands. The antenna system achieves relatively small size by a combination of techniques including dielectric loading, sub-resonance antenna design and a tuning circuit.

The UHF frequency band lies between the microwave frequencies above and VHF frequencies below. Due to this unique position, the typical UHF-band wavelength is short enough to allow dielectric loading while at the same time, the frequency is low enough to allow effective compensation using reactive elements below their self resonance frequencies. The antenna system takes advantage of this to provide a miniaturized antenna suitable for use in the VHF/UHF frequency bands. Thus, the novel antenna solution presented herein utilizes both dielectric loading and reactive compensation to achieve a miniature antenna system for receiving/transmitting electromagnetic radiation in the UHF (470-860 MHz) and VHF (200-300 MHz) bands. Applications of the antenna system include, for example, mobile phones, portable multimedia devices, notebooks and accessory cards.

The antenna system comprises two basic components. The first component is an antenna element miniaturized by the use of dielectric loading. The antenna element is tuned to a frequency substantially higher than desired (i.e. sub-resonant), thereby permitting a significant decrease in its size even further. The second component is an active wideband digital tuning circuit designed to compensate for the intentionally mistuned antenna element. The tuning circuit also permits coverage of a relatively wide desired frequency range. Note that in one embodiment, the antenna is designed to resonate at a frequency at the upper end of the desirable frequency band and not necessarily at a frequency higher than the desirable frequency band. The antenna is then tuned to the lower desired frequency via the tuning circuit.

A diagram illustrating the footprint and mechanical dimensions of an example antenna element is shown in FIG. 1. The antenna element, generally referenced 10, comprises one or more planar conductive layers disposed on a ceramic substrate. In an example embodiment, the antenna element comprises a multi-layer ceramic chip antenna such as commercially available model RFW8021 Chip Antenna for Mobile Devices, manufactured by Vishay Intertechnology, Inc., Migdal Ha'emek, Israel. This chip antenna is a small form factor, high performance, chip antenna designed for TV reception in mobile devices in the UHF band. It allows mobile TV device manufacturers to design high quality products without the penalty of a large external antenna. The antenna utilizes a ceramic dielectric, described in more detail infra, which enables compliance with the Mobile and Portable DVB-T/H Radio Access Interface (MBRAI) specification while maintaining a small outline. Note that it is not intended that the invention be limited to the example chip antenna presented herein as numerous other antenna elements may be used with the invention.

Antenna Miniaturization Using Dielectric Loading

Dielectric loading is a technique for reducing the size of an antenna. This technique is operative to shorten the wavelength by decreasing the speed of light in accordance with the following equation.

$$\lambda = \frac{1}{f\sqrt{\varepsilon\mu}} \tag{1}$$

where $\lambda$ represents wavelength;

f represents frequency;

$\in$ represents permittivity;

$\mu$ represents permeability;

Note that not all of the theoretical shortening can be obtained because the dielectric element is significantly smaller that the wavelength in air. Nevertheless, the effects of dielectric loading are used to advantage in the antenna system. Note further that additional miniaturization can be achieved be increasing the value of the permeability of the substrate.

Normally the antenna wavelength is dictated by the receiver requirements. The frequency cannot be controlled because it is a requirement of the antenna. Given an antenna design and a frequency and wavelength, the wavelength can be reduced using high dielectric material. A smaller antenna that still operative at a given frequency is obtained by increasing the dielectric constant of the antenna. Note that there are other parameters that affect the wavelength, such as the magnetic permeability. Using a substrate with a higher permeability achieves the same effect as using a high dielectric material.

Sub-Resonant Antenna Design

From Equation 1 above it can be seen that antenna miniaturization can also be achieved by tuning the antenna to a higher frequency. Antennas that operate below their natural resonance frequency (i.e. antennas in sub-resonance), however, suffer from low efficiency mainly due to impedance mismatches between the antenna and any connected transmitter/receiver.

Figure 8:
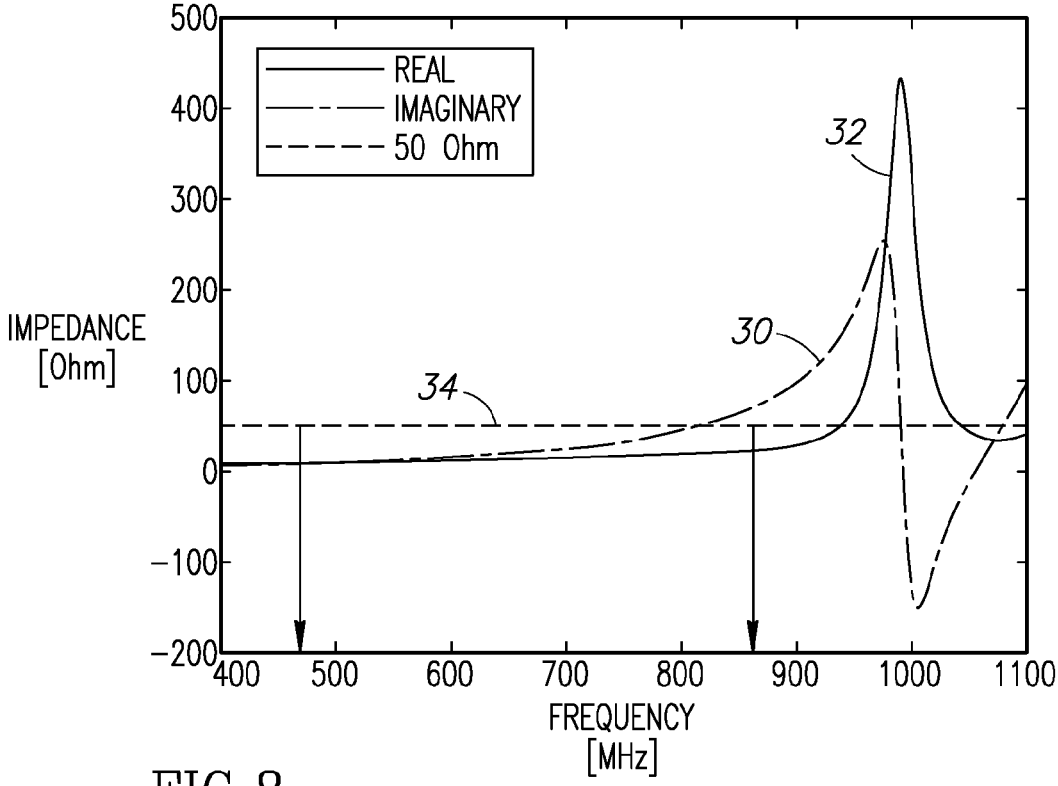
FIG. 8 is a graph illustrating the simulated impedance of a 3 cm monopole antenna set on a ceramic substrate.

The invention turns this impedance mismatch into an advantage by utilizing the following two design principles:

1. The real part of the antenna's impedance reaches its largest value at resonance. By carefully manipulating the antenna parameters, the antenna can be adapted to resonate at a higher frequency than desired while returning exhibiting real impedance of 50 Ohm within the desired frequency band. Due to the fact that the resonance itself takes place at a higher frequency, the slope of the real part of the impedance changes relatively slowly inside the desired band. This is shown in FIG. 8 wherein trace 32 is the real part of the impedance and changes slowly within the UHF frequency band denoted by the two vertical arrows.

2. The imaginary part of the impedance can be negated using a tuning circuit. Using a tuning circuit allows the antenna to be tuned to the desired frequency while being miniaturized (1) utilizing dielectric loading and (2) intentionally tuning the antenna element to a higher frequency.

Tuning Circuit

An antenna tuning circuit functions as an impedance matching network that matches the antenna's impedance for maximum power transfer to and from the source. Utilizing a tuning circuit, the frequency is shifted thereby covering the entire desired frequency band. The imaginary part of the impedance can be either positive (i.e. capacitive) or negative (i.e. inductive) inside the desired frequency band. The imaginary impedance can be negated by adding one or more passive reactive components. Once the imaginary part is negated, only the real part remains which is adapted to be 50 Ohm. Thus, the antenna is tuned to 50 Ohm at the desired frequency. Several example antenna tuning circuits suitable for use with the present invention are presented infra.

It is important to note that the antenna can be tuned to any desired impedance using shunt reactive elements to manipulate both the real and imaginary impedance. It is appreciated that the principles of the present invention can be applied to numerous antenna systems wherein the tuning circuit is constructed as a combination of series and/or parallel reactance elements arranged so as to achieve any desired impedance at the desired frequency band.

The antenna is thus tuned at a given point thereby creating a relatively narrow band antenna. Because the real part of the impedance changes slowly inside the target frequency band, however, the antenna can be tuned to different points by switching between several passive reactive components.

In accordance with the present invention, the three techniques of (1) utilizing dielectric loading, (2) designing the antenna to resonate at a frequency significantly higher than required, and (3) utilizing an active tuning circuit, a system for transmitting and/or receiving electro magnetic radiation having a miniature form factor can be constructed. Although the techniques of the present invention can be applied to numerous frequencies, it is particularly applicable for use with the VHF (200-300 MHz) band and the adjacent UHF (470-860 MHz) band.

Performance of Example Antenna

The performance of the example chip described supra will now be presented. The radiation characteristics of the antenna are influenced by several factors including ground plane dimensions and the impedance matching network used. The antenna parameters presented hereafter were measured utilizing a four channel active digital tuning circuit. The dimensions of the ground plane used are approximately 40 by 80 mm.

Figure 2:
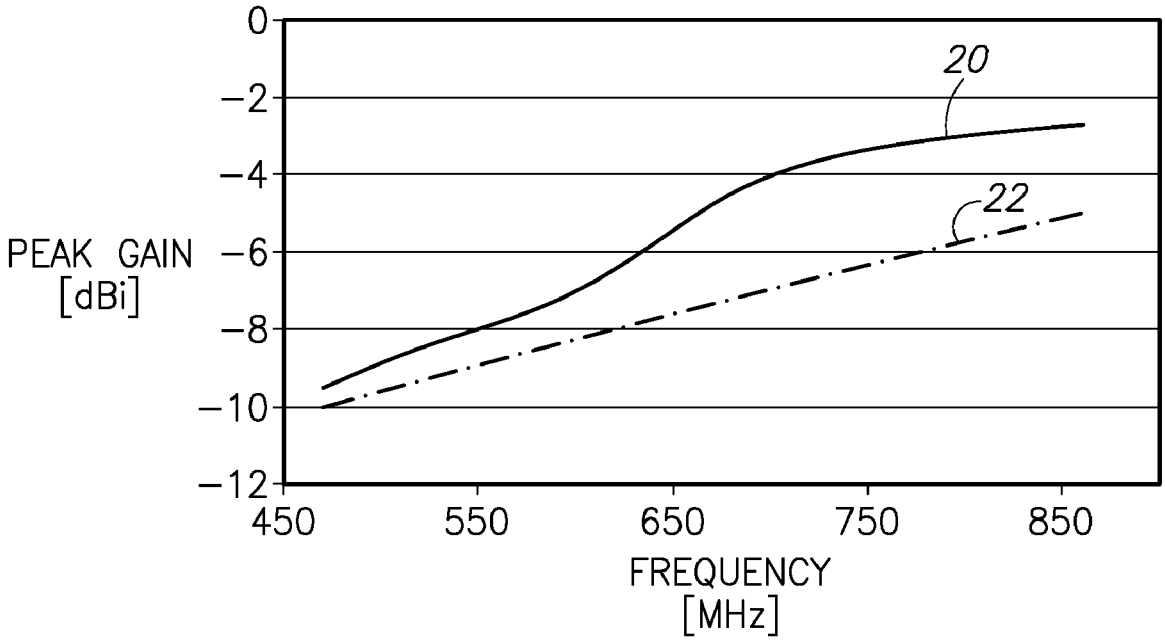
FIG. 2 is a diagram illustrating the peak gain versus frequency for the example antenna element.

A diagram illustrating the peak gain over frequency throughout the UHF band for the example antenna element is shown in FIG. 2. For comparison purposes, the peak gain is shown along with the MBRAI specification requirements. The solid trace 20 represents the measured peak gain while the dashed trace 22 represents the MBRAI specification.

Figure 3:
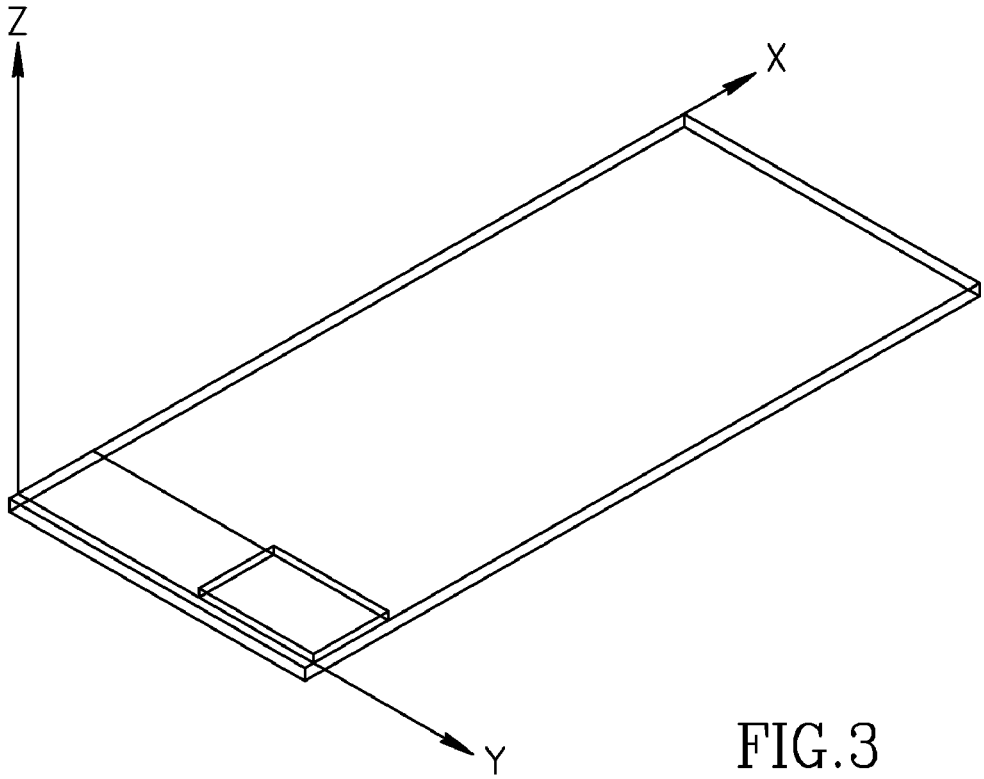
FIG. 3 is a diagram illustrating the 3D radiation pattern of the example antenna element.
Figure 4:
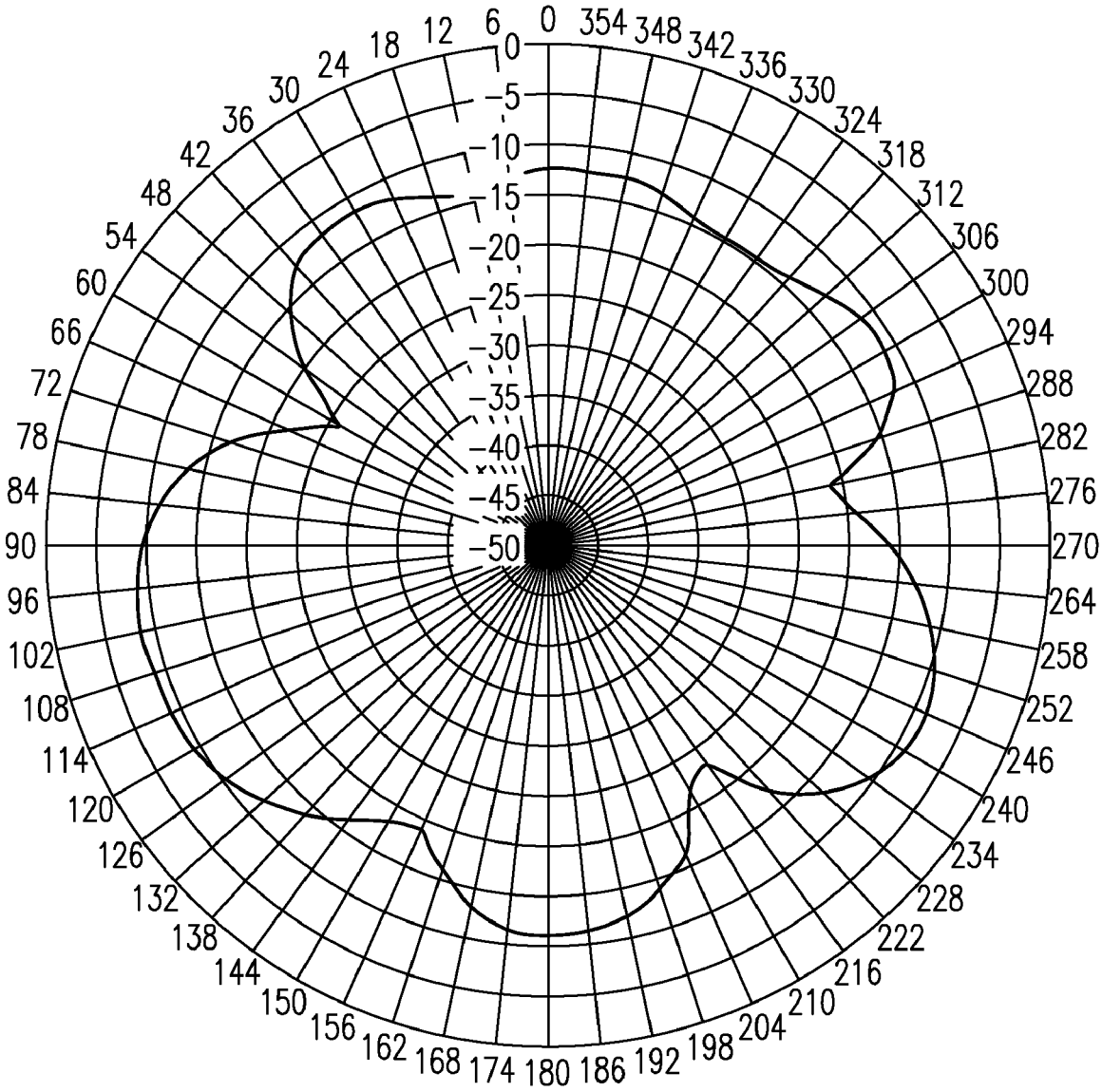
FIG. 4 is a diagram illustrating the measured radiation pattern for the example antenna element in the YZ plane at 500 MHz.
Figure 5:
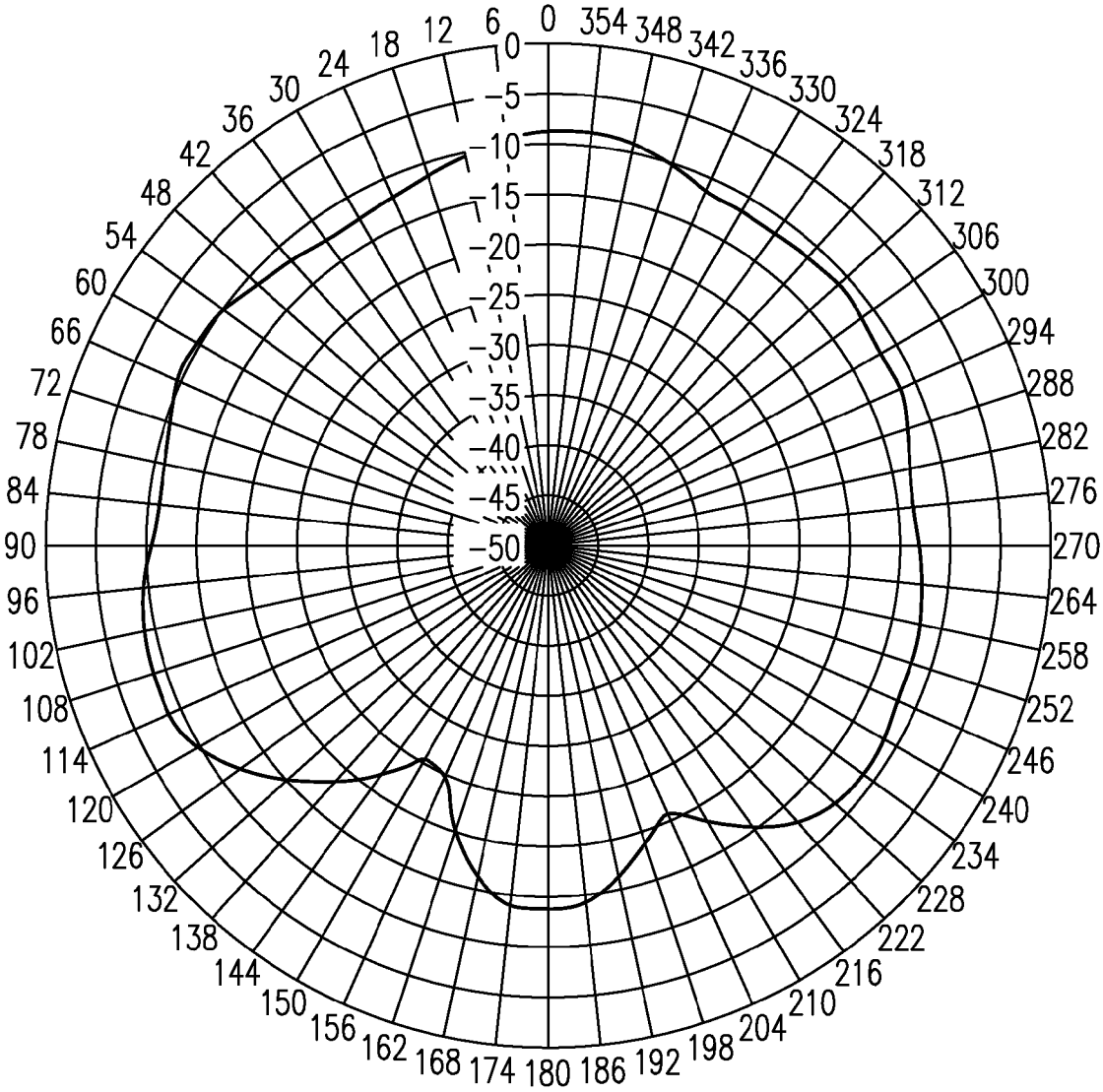
FIG. 5 is a diagram illustrating the measured radiation pattern for the example antenna element in the YZ plane at 600 MHz.
Figure 6:
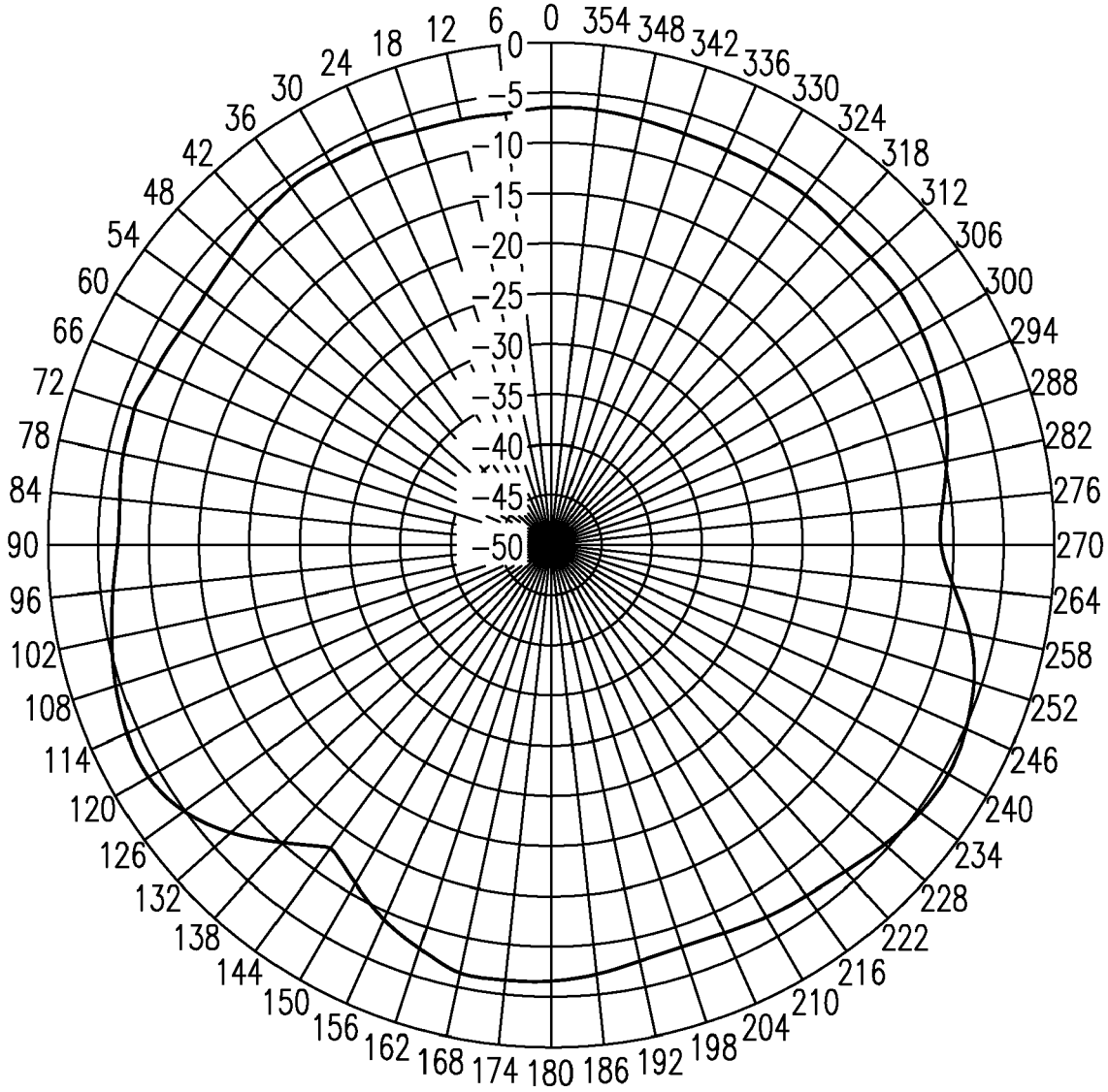
FIG. 6 is a diagram illustrating the measured radiation pattern for the example antenna element in the YZ plane at 700 MHz.
Figure 7:
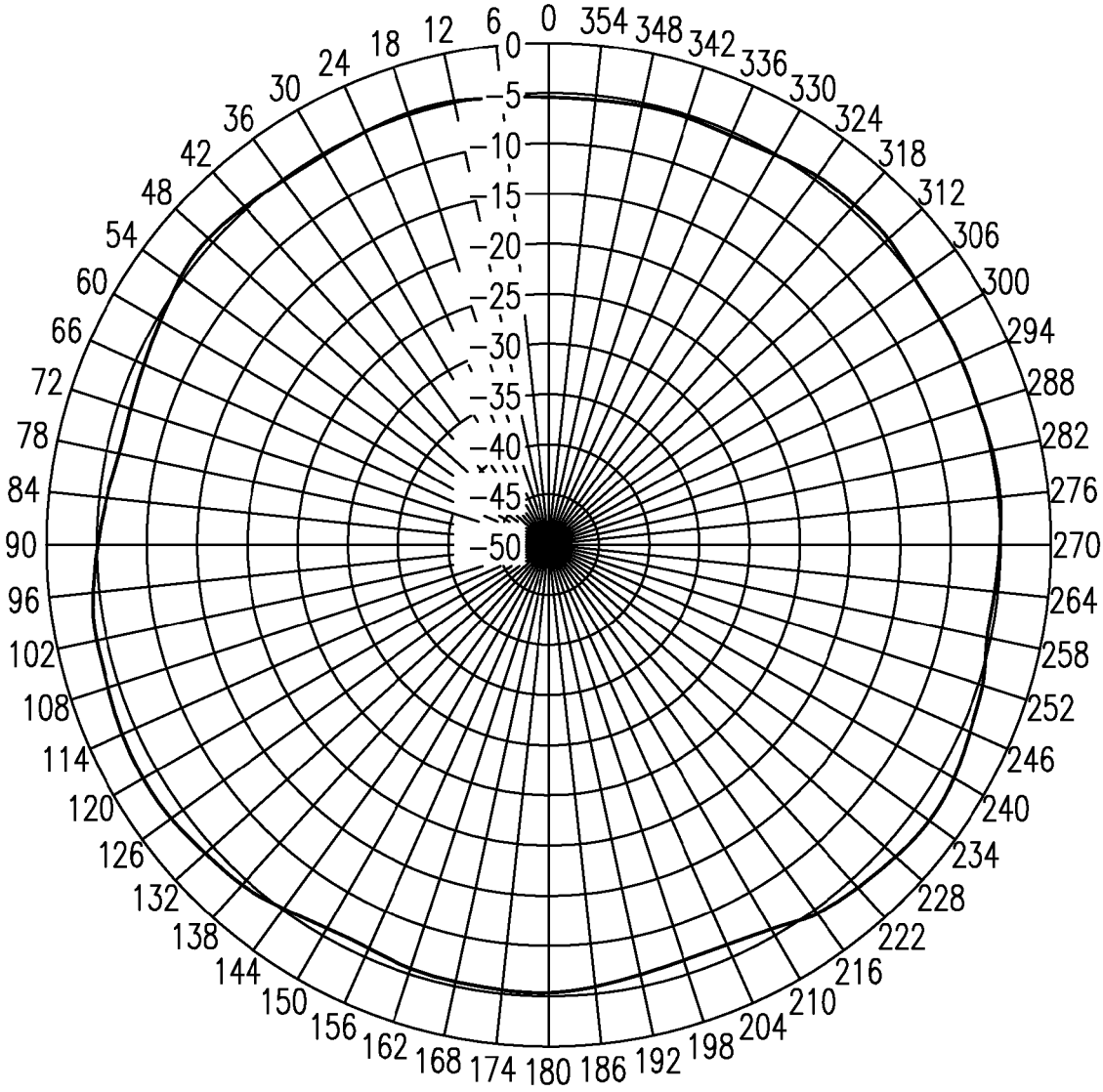
FIG. 7 is a diagram illustrating the measured radiation pattern for the example antenna element in the YZ plane at 800 MHz.

A diagram illustrating the 3D radiation pattern of the example antenna element is shown in FIG. 3. A diagram illustrating the measured radiation pattern for the example antenna element in the YZ plane as defined in FIG. 3 at 500, 600, 700 and 800 MHz is shown in FIGS. 4, 5, 6 and 7, respectively. Note that zero degrees is defined at the Z axis, stepping counter clockwise.

EXAMPLE ANTENNA SYSTEM

In this illustrative example, a miniature system for receiving TV broadcasting in the UHF frequency range 470-860 MHz is described. In accordance with the invention, the antenna utilizes dielectric loading that is achieved by using a ceramic substrate with a dielectric constant significantly higher than 100. Combined with the dielectric constant of the FR4 printed circuit board (PCB) on which the antenna is fabricated yields an effective measured dielectric constant of 10.

A quarter wavelength monopole radiating element measuring 3 cm was fabricated on the ceramic substrate. The antenna element resonates at a frequency close to 1 GHz. In this configuration, the natural resonance of the radiating element is significantly higher than the upper limit of the desired frequency band (i.e. the UFH band).

It is important to note that normally a quarter wavelength monopole antenna designed to resonate at 600 MHz in free space would be 13 cm long. Thus, dielectric loading combined with intentionally designing the antenna to a higher frequency results in an antenna whose size is approximately four times smaller than would otherwise be possible.

A graph illustrating the simulated impedance of a 3 cm monopole antenna set on a ceramic substrate is shown in FIG. 8. Dashed line 34 represents a constant 50 Ohm, trace 32 presents the real part of the impedance, while trace 30 represents the imaginary part of the impedance. The real part of the impedance (trace 32) changes relatively slowly within the band of interest (e.g., UHF as delineated by the vertical arrows) from around 30 Ohm at the upper end (i.e. 860 MHz) to 10 Ohm at the lower end (i.e. 470 MHz). The imaginary part of the impedance (trace 30) remains positive throughout the band and varies between 100 Ohm at the upper end and 10 Ohm at the lower end.

Figure 9:
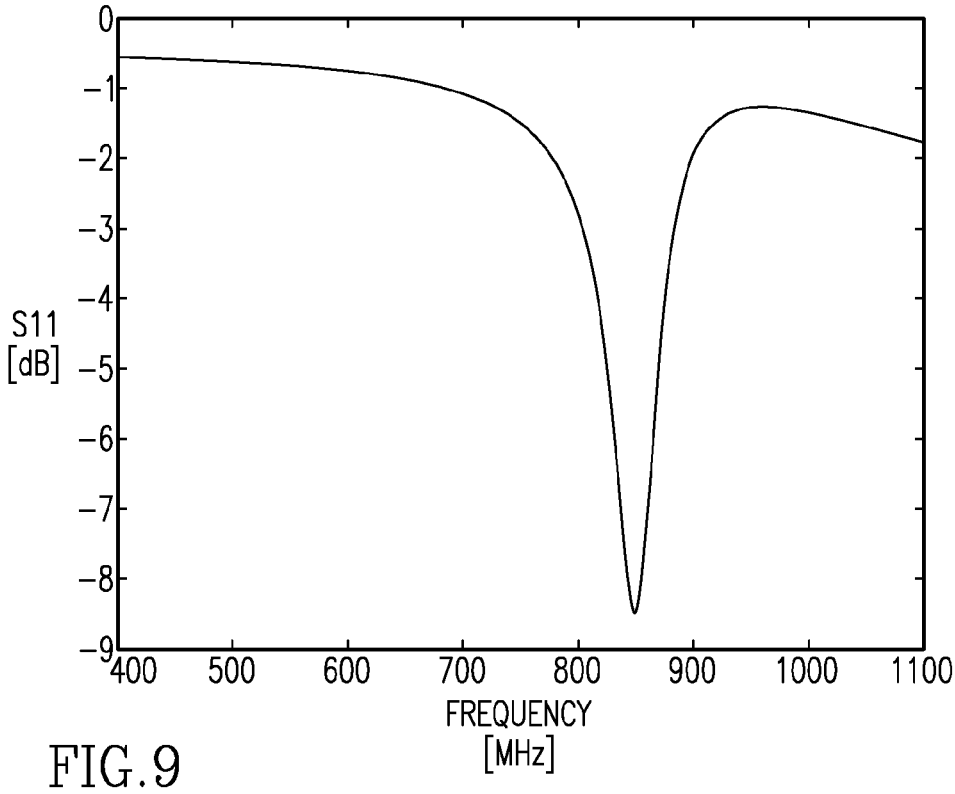
FIG. 9 is a graph illustrating the S11 response of the 3 cm monopole antenna tuned to 850 MHz using a single series inductor.

The antenna is tuned to a particular frequency within the UHF band using passive (or active) reactive components as described in more detail infra. As an example, a single inductor placed in series with the antenna element can tune the antenna to any frequency within the UHF band. The resulting antenna, however, is relatively narrow band. A graph illustrating the simulated S11 response of the 3 cm monopole antenna tuned to 850 MHz using a single series inductor is shown in FIG. 9.

Antenna Tuning Circuit

A tuning circuit for an antenna is in essence an ideally lossless reactive network, based on reactive inductors, capacitors and variable capacitors (i.e. varicaps). The tuning circuit functions as an impedance matching network that matches the antenna's impedance for maximum power transfer to and from the source.

Utilizing a tuning circuit, the frequency is shifted thereby covering the entire desired frequency band. Note that such a tuning circuit can be implemented in numerous ways wherein the particular tuning circuit used in the antenna system is not critical to operation of the invention. One example of a tuning circuit suitable for use with the present invention is described in U.S. Pat. No. 4,564,843, to Cooper, entitled "Antenna with P.I.N. diode switched tuning inductors," incorporated herein by reference in its entirety. Additional example tuning circuits suitable for use with the invention are described is U.S. application Ser. No. 11/759,594, entitled "Digitally controlled antenna tuning circuit for radio frequency receivers," incorporated herein by reference in its entirety. Several tuning circuits described therein are presented below.

First Example Antenna Tuning Circuit

Figure 10:
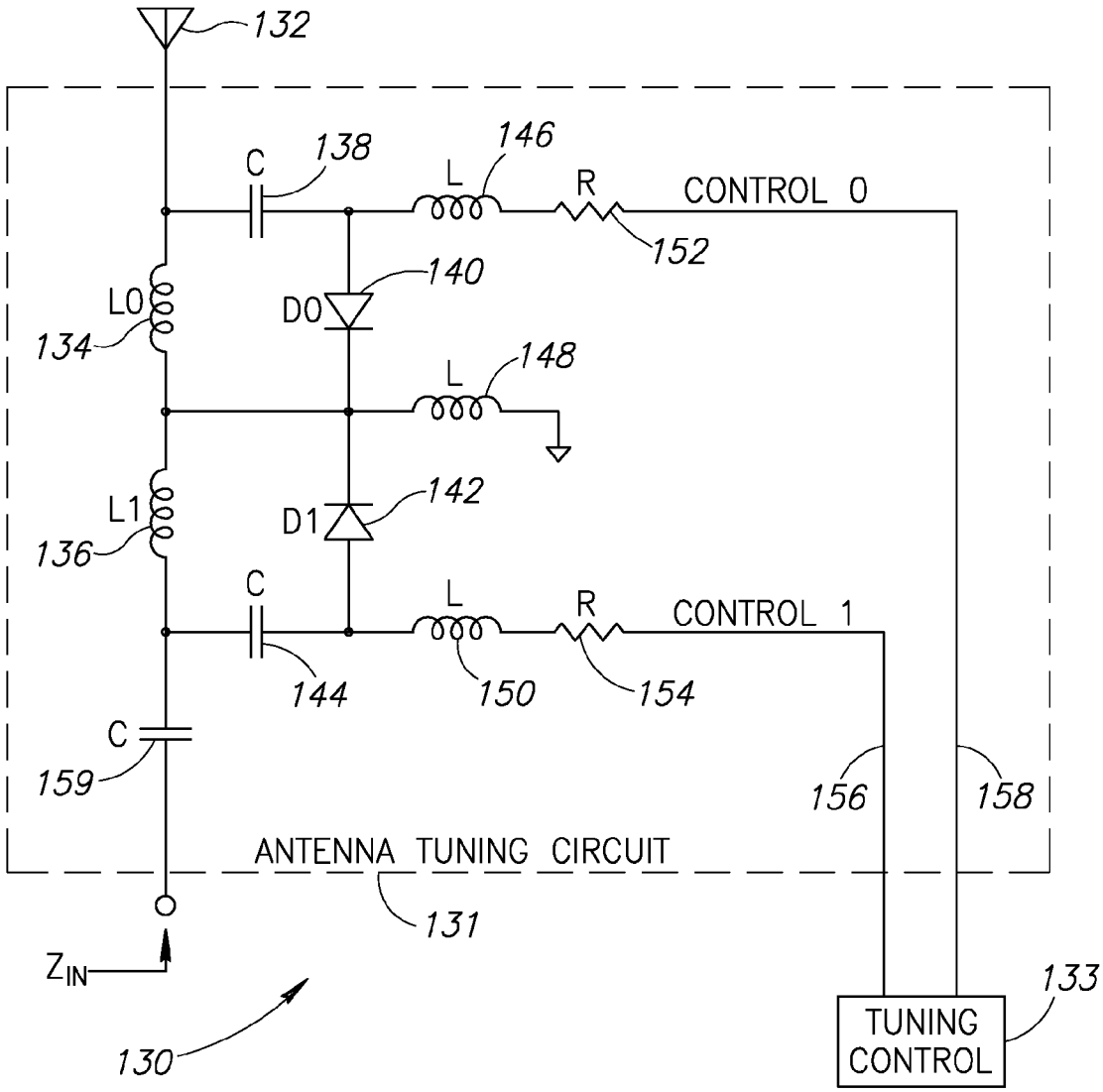
FIG. 10 is a schematic diagram illustrating a first example embodiment of an antenna tuning circuit having series connected tuning elements.

A schematic diagram illustrating a first example of an antenna tuning circuit suitable for use with the antenna system of the present invention having series connected tuning elements is shown in FIG. 10. The circuit, generally referenced 130, comprises a tuning circuit 131 coupled to antenna element 132 and a tuning control circuit 133. The antenna element 132 may comprise a chip antenna such as that described in detail supra. The tuning circuit comprises two series connected tuning stages comprising tuning elements made up of inductors L0 (134), L1 (136), DC blocking capacitors C 138, 144, 159, RF chokes L 146, 148, 150, resistors R 152, 154 and switching devices comprising PIN diodes D0 (140), D1 (142).

In accordance with the invention, it is assumed that the signals flowing through the main receive signal path are sufficiently weak enough to allow the use of a single PIN diode to short circuit a single tuning stage. In the example circuit 130, the main receive signal path comprises two tuning elements connected in series (L0 and L1).

A PIN diode is a diode with a wide, undoped intrinsic semiconductor region between p-type semiconductor and n-type semiconductor regions. PIN diodes act as near perfect resistors at RF and microwave frequencies. The resistance is dependent on the DC current applied to the diode. The benefit of a PIN diode is that the depletion region exists almost completely within the intrinsic region, which is almost a constant width regardless of the reverse bias applied to the diode. This intrinsic region can be made large, increasing the area where electron-hole pairs can be generated.

By changing the bias current through a PIN diode, it is possible to quickly change its RF resistance. At high frequencies, the PIN diode appears as a resistor whose resistance is an inverse function of its forward DC bias current. Thus, in operation, a PIN diode is an RF element that can be in one of two operating modes. The first mode of operation is when the diode is not DC biased forward (i.e. zero or reverse bias) where it presents very high capacitive AC impedance (i.e. low capacitance). The low capacitance will not pass much of an RF signal. In the second mode of operation, the diode is DC biased forward where it presents very low resistive AC impedance.

Two switching elements comprising PIN diodes D0 and D1 are connected in parallel to inductors L0 and L1, respectively. Each of the PIN diodes has two switching states (i.e. operating modes), namely either forward biased or not forward biased. By switching the diodes between their two operating modes, inductors L0 and L1 are individually short circuited.

The digital control lines Control0 158 and Control1 156 provide four possible combinations of tuning circuits.

For example, when the digital control signal Control0 is high, the diode D0 is in forward bias. A PIN diode in forward bias can be considered a resistor with very low resistance value for RF signals. Given this diode is parallel to the inductor L0, L0 can be effectively replaced by a short circuit. Therefore, when the Control0 signal voltage applied to diode D0 is high, L0 is electrically short circuited. Note that the impedance of the DC blocking capacitor is negligible at the operating RF frequencies of the circuit. The tuning control circuit 133 provides the appropriate DC bias voltages on the control signals Control0 and Control1 to yield the desired impedance $Z_{IN}$ of the antenna tuning circuit 131.

It is important to note that the capacitors labeled 'C' (138, 144) are used as AC coupling devices to avoid connecting the PIN diode directly parallel to the inductor. Typical values of capacitance C should be chosen high enough such that the capacitors can be considered very low impedances at the operating radio frequency of the system.

Similarly, the inductors labeled 'L' are used as DC couplings (AC blocking) to prevent RF leakage from the main receive signal path to the digital control signals. Typical values of inductance L should be chosen high enough such that the inductors can be considered very high impedances at the operating radio frequency of the system.

Further, the resistors labeled 'R' as used as current limiters to set the DC bias voltage of the PIN diodes at a suitable value. The value of resistance R should be selected in accordance with (1) the desired operating point and (2) the voltage provided by the digital control signal.

An illustrative example provided as a guideline in selecting the values of the AC coupling capacitors C, AC blocking inductors L and current limiting resistors R is provided infra.

Second Example Antenna Tuning Circuit

Figure 11:
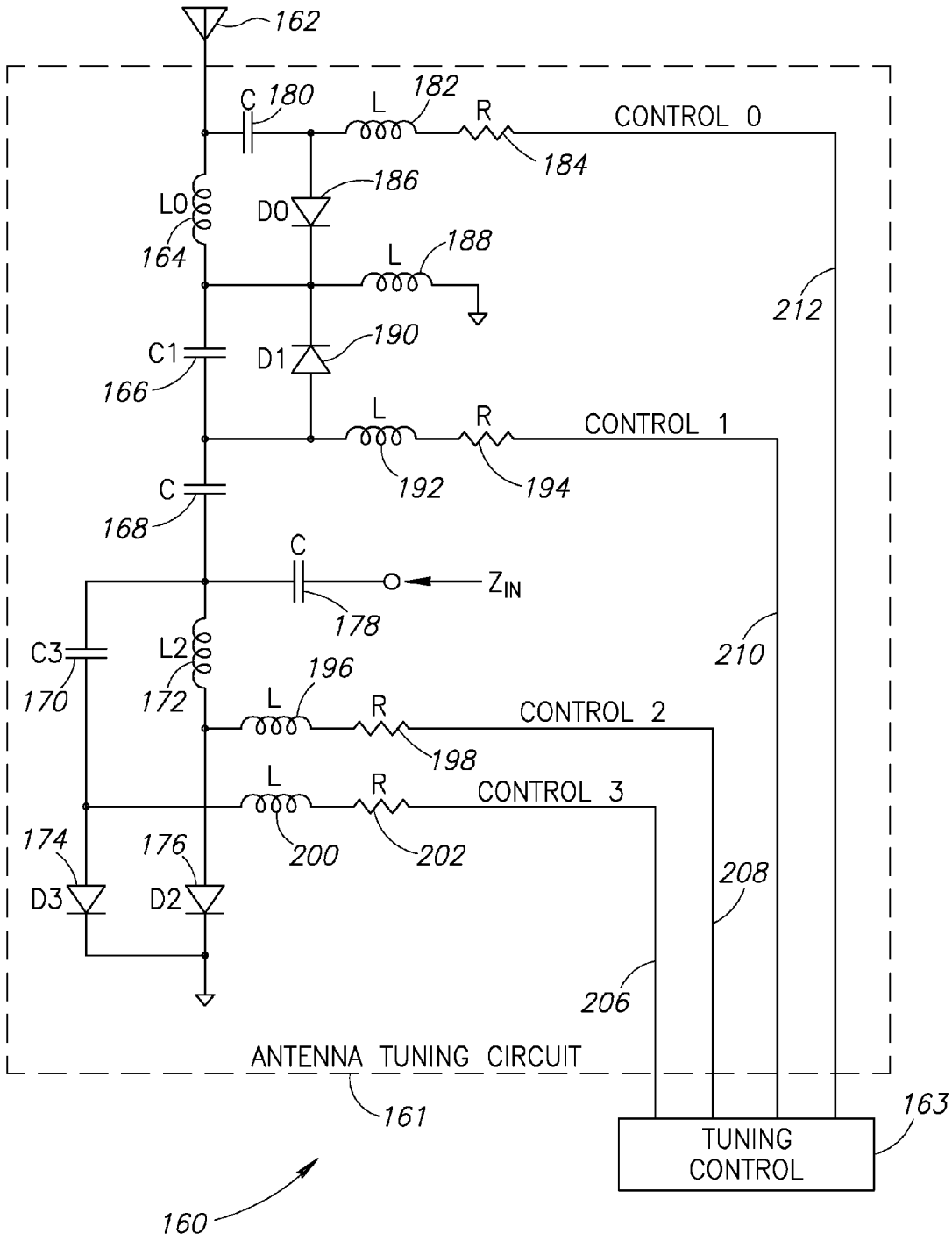
FIG. 11 is a schematic diagram illustrating a second example embodiment of an antenna tuning circuit having a combination of series connected and parallel connected tuning elements.

A schematic diagram illustrating a second example of an antenna tuning circuit suitable for use with the antenna system of the present invention having a combination of series connected and parallel connected tuning elements is shown in FIG. 11. The circuit, generally referenced 160, comprises a tuning circuit 161 coupled to antenna element 162 and a tuning control circuit 163. The antenna element may comprise a chip antenna such as that described in detail supra. The tuning circuit comprises four tuning stages arranged in a series-parallel combination which includes two series connected tuning stages comprising tuning elements made up of inductor L0 (164), capacitor C1 (166) and two parallel connected tuning stages comprising tuning elements made up of inductor L2 (172), capacitor C3 (170), DC blocking capacitors C 180, 168, 178, RF chokes L 182, 188, 192, 196, 200, resistors R 184, 194, 198, 202 and switching devices comprising PIN diodes D0 (186), D1 (190), D2 (176), D3 (174).

In this example circuit 161, four tuning stages are connected in a series-parallel combination to form the main receive signal path. Two tuning stages comprising tuning elements inductor L0 and capacitor C1 are connected in a series configuration. Corresponding PIN diodes D0 and D1 connected in series to the tuning elements L0, C1 act as switches to switch each respective tuning element either into or out of the main receive signal path in accordance with a respective control signal Control0 212, Control1 210 provided by the tuning control circuit 163.

The two switching elements comprising PIN diodes D0 and D1 are connected in parallel to tuning elements L0 and C1, respectively. Each of the PIN diodes has two switching states (i.e. operating modes), namely either forward biased or not forward biased. By switching the diodes between their two operating modes, inductor L0 and capacitor C1 are individually short circuited.

For example, when the digital control signal Control0 is high, the diode D0 is in forward bias. A PIN diode in forward bias can be considered a resistor with very low resistance value for RF signals. Given this diode is parallel to the inductor L0, L0 can be effectively replaced by a short circuit. Therefore, when the Control0 signal voltage applied to diode D0 is high, L0 is electrically short circuited. Similarly, when the Control1 signal voltage applied to diode D1 is high, C1 is electrically short circuited.

The circuit also comprises two tuning stages made up of tuning elements inductor L2 and capacitor C3 connected in a parallel configuration and coupled to the series combination via capacitor C 168. L2 and C3 function as shunt elements to ground in the tuning circuit. Corresponding PIN diodes D2 and D3 connected in series with the tuning elements L2, C3 act as switches to switch each respective tuning element either into or out of the main receive signal path in accordance with a respective control signal Control2 208, Control3 206 provided by the tuning control circuit 163. When D2 and D3 are non-RF conducting, L2 and C3 are not part of the tuning circuit. When D2 and D3 are conducting, L2 and C3 add shunt reactance to the tuning circuit.

In this example, the four control signals (Control0, Control1, Control2, Control3) provide for 16 possible $Z_{IN}$ impedance values for the antenna tuning circuit 161. For example, all loads (L0, C1, L2 and C3 are connected when D0, D1 are off (i.e. zero or reversed biased) and D2, D3 are on (i.e. forward biased).

In the parallel combination of L2, C3, a high voltage on a control signal is operative to forward bias the diode thereby electrically inserting the corresponding tuning element into the main receive signal path. A low on a control signal leaves its corresponding PIN diode in a non-forward biased operating state thereby effectively removing the corresponding tuning element from the main receive signal path.

Note that placing the PIN diodes D2, D3 in series with their respective tuning elements L2, C3 provides the capability to connect L2, C3 to the main signal path separately. For example, when the digital control signal Control2 is in a high voltage state, the corresponding diode D2 is forward biased. A forward biased PIN diode can be considered a resistor having very low resistance for RF signals. Since this diode is connected in series to L2, L2 can be effectively considered connected to the main receive signal path. Similarly, when Control3 signal on diode D3 is high, capacitor C3 is also electrically inserted into the main receive signal path.

A truth table listing all possible 16 combinations of the control signals for the antenna tuning circuit in the example circuit 161 of FIG. 9 is presented below in Table 1 where the admittance Y is defined as Y=1/Z. For the shunt reactances L2 and C3, the admittance Y is used rather than the impedance Z. It is important to note that the expressions for the Total Tuning Impedance given in the last column of the table are not exact and should only be considered as approximate qualitative expressions for the total impedance. This is because the expressions do not take into account the effects of the load mirroring onto the real and imaginary parts of the impedance. The table does, however, provide expressions that indicate the particular reactive elements that are active for each of the 16 combinations of control signals.

TABLE 1

Antenna Tuning Circuit Truth Table

| Control0 | Control1 | Control2 | Control3 | Active Inductors | Active Capacitors | Total Tuning Impedance |
|---|---|---|---|---|---|---|
| 0 | 0 | 0 | 0 | L0 | C1 | $Z_{L0}+Z_{C1}$ |
| 0 | 0 | 0 | 1 | L0 | C1, C3 | $Z_{L0}+Z_{C1}+Y_{C3}$ |
| 0 | 0 | 1 | 0 | L0, L2 | C1 | $Z_{L0}+Z_{C1}+Y_{L2}$ |
| 0 | 0 | 1 | 1 | L0, L2 | C1, C3 | $Z_{L0}+Z_{C1}+Y_{L2}+Y_{C3}$ |
| 0 | 1 | 0 | 0 | L0 | — | $Z_{L0}$ |
| 0 | 1 | 0 | 1 | L0 | C3 | $Z_{L0}+Y_{C3}$ |
| 0 | 1 | 1 | 0 | L0 | L2 | $Z_{L0}+Y_{L2}$ |
| 0 | 1 | 1 | 1 | L0, L2 | C3 | $Z_{L0}+(Y_{L2}+Y_{C3})$ |
| 1 | 0 | 0 | 0 | — | C1 | $Z_{C1}$ |
| 1 | 0 | 0 | 1 | — | C1, C3 | $Z_{C1}+Y_{C3}$ |
| 1 | 0 | 1 | 0 | L2 | C1 | $Z_{C1}+Y_{L2}$ |
| 1 | 0 | 1 | 1 | L2 | C1, C3 | $Z_{C1}+(Y_{L2}+Y_{C3})$ |
| 1 | 1 | 0 | 0 | — | — | 0 Ohm (short circuit) |
| 1 | 1 | 0 | 1 | — | C3 | $Y_{C3}$ |
| 1 | 1 | 1 | 0 | L2 | — | $Y_{L2}$ |
| 1 | 1 | 1 | 1 | L2 | C3 | $Y_{L2}+Y_{C3}$ |

For each value of the four control signals, the inductors and capacitors that are made active, i.e. electrically inserted into the main receive signal path, are listed along with the corresponding total antenna tuning impedance.

Illustrative Antenna Tuning Circuit Example

To aid in understanding the principles of the present invention, an illustrative example is provided in which guidelines are provided for selecting the values of the AC coupling capacitors C, the RF chokes L for blocking AC (DC coupling) and the current limiting resistors R.

For this example, it is assumed that the operating frequency of the circuit is 1 GHz. The PIN diode represents a 1 Ohm resistance when biased with 10 mA of current with a 1 V dropout. Assume the digital control signals swing from 0 V to 3 V.

To select the value C of the capacitor, its impedance at the operating frequency is considered. In this example, the impedance of the capacitor C should preferably be much less than 1 Ohm at 1 GHz operating frequency to provide an effective electrical short at RF frequencies. With these parameters and constraints, the expression for the value of the impedance $Z_C$ is given by $$Z_C = \frac{1}{2\pi fC} \ll 1 \text{ Ohm} \tag{2}$$

Solving for C yields the following $$C \gg \frac{1}{2\pi f} = \frac{1}{2\pi \times 10^9} = 159 \text{ pF} \tag{3}$$

To select the value L of the inductor, its impedance at the operating frequency is considered. In this example, the impedance of the inductor L should preferably be much more than 1 Ohm at 1 GHz operating frequency to provide an effective electrical open at RF frequencies. With these parameters and constraints, the expression for the value of the impedance $Z_L$ is given by $$Z_L = 2\pi fL >> 1 \text{ Ohm} \tag{4}$$

Solving for L yields the following $$L \gg \frac{1}{2\pi f} = \frac{1}{2\pi \times 10^9} = 159 \text{ pH} \tag{5}$$

It is important to note that at some point, as the value of C and L increases, the affects of self-resonance come into play. This should be taken into account when selecting the values of C and L for the tuning circuit.

The value of the resistor R should be chosen such that it generates a voltage drop of approximately 2 V to allow for a 1 V drop across the PIN diode and that it conducts 10 mA of current. The following expression solves for the value of the resistor R.

$$R = \frac{V}{I} = \frac{2}{0.01} = 200 \text{ Ohms} \tag{6}$$

Multi-Band Antenna Using Bypass Switch

As described supra, the invention provides a miniaturized antenna that is achieved by deliberately designing the antenna element (e.g., chip antenna) to resonate at a significantly higher frequency than required. Additional miniaturization is achieved by using a high dielectric substrate in the construction of the antenna element. A tuning circuit is used which is adapted 'force' the antenna to resonate at the desired frequency.

In accordance with the invention, a multi-band antenna embodiment is provided that is capable of tuning to more than one frequency band. This is achieved by setting the significantly higher frequency to which the antenna element is tuned to a first useful frequency band. The operation of the tuning circuit, as described supra, tunes the antenna to a second lower frequency band. This allows the antenna system to be tuned to more than one frequency. A bypass switch is used to selectively tune the antenna to either the first or the second frequency band.

Figure 12:
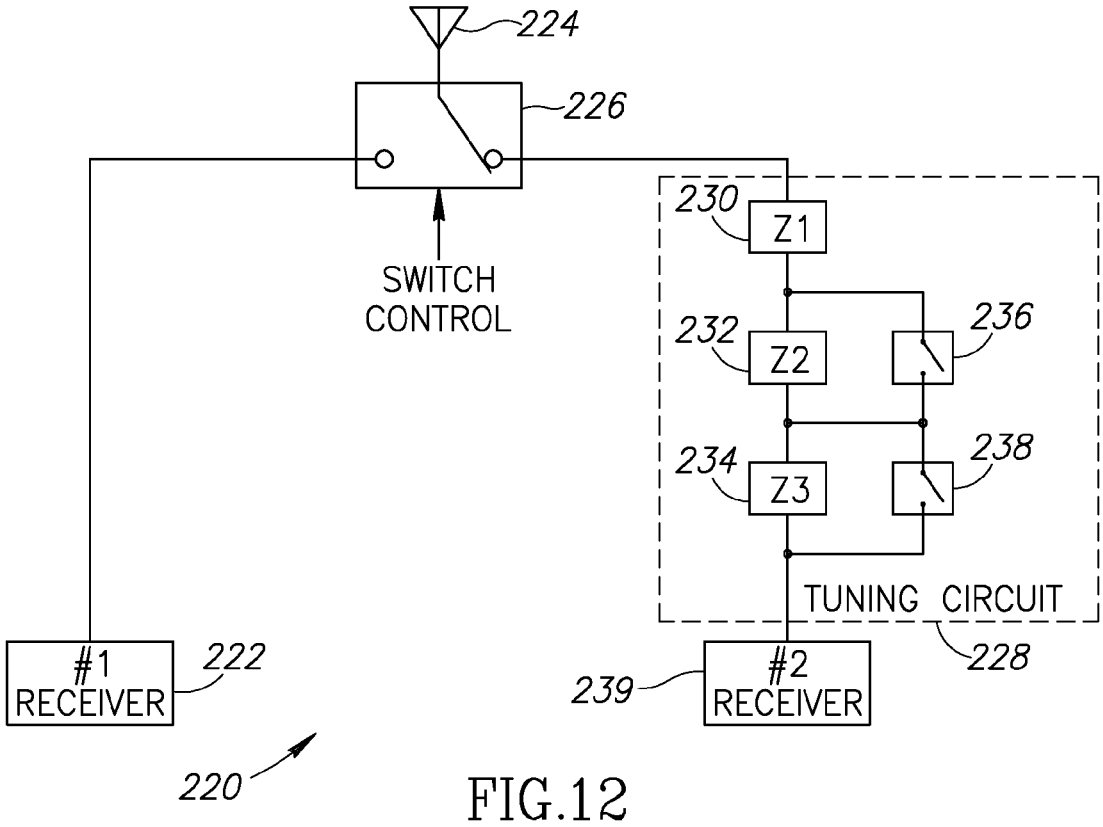
FIG. 12 is a block diagram illustrating a first example multi-band antenna system incorporating a bypass switch.

A block diagram illustrating a first example multi-band antenna system incorporating a bypass switch is shown in FIG. 12. The circuit, generally referenced 220, comprises antenna element 224 (e.g., chip antenna), bypass switch 226 electrically connected to the antenna element, tuning circuit and receiver #2 (222), and tuning circuit 228 electrically connected between the antenna element and a receiver #1 239. The tuning circuit 228, comprises impedances Z1 230, Z2 232, Z3 234 and switches 236, 238. Note that the actual circuit used for the tuning circuit is not critical to the invention.

In operation, a switch control signal 227 controls the operation of the bypass switch. The switch connects the antenna element to either (1) receiver #2 (222) without the tuning circuit or (2) to receiver #1 (239) with the tuning circuit. When the bypass switch connects the antenna element to the tuning circuit, the antenna system is tuned to the lower frequency band. When the bypass switch connects the antenna element to receiver #2 (222), the antenna system is tuned to the natural higher resonant frequency of the antenna element.

Thus, the antenna system operates in one of either two modes:

Mode 1: In this mode of operation, the tuning circuit is bypassed and the antenna element is allowed to resonate at its natural frequency. This natural frequency is chosen to be a useful desired frequency band.

Mode 2: In the second mode of operation, the tuning circuit is not bypassed and is electrically coupled to the antenna element. The tuning circuit 'forces' the antenna to resonate at the desired lower frequency band.

Thus, at any give time, the antenna functions in one of the modes described above. The selection between the modes is achieved by operation of the bypass switch 226 coupled to the tuning circuit. The actual tuning frequencies are determined by selecting the appropriate resonant frequency for the antenna element which determines the upper frequency band and the appropriate frequency for the tuning circuit which determines the lower frequency band.

Figure 13:
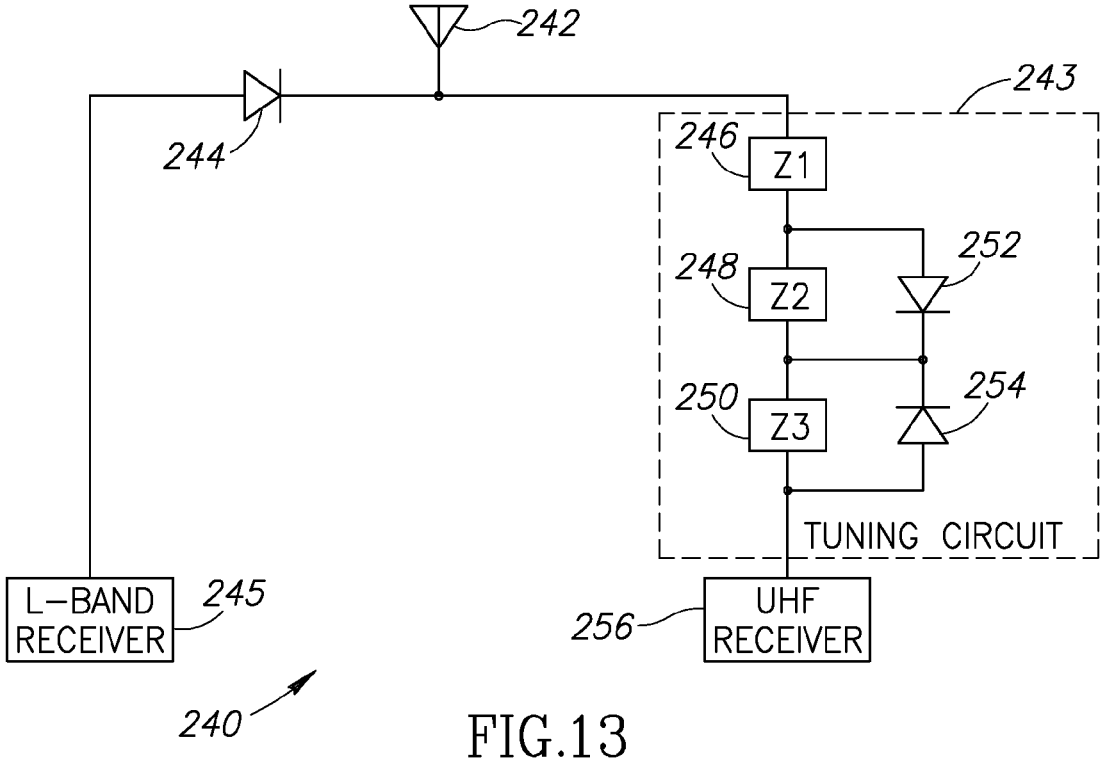
FIG. 13 is a block diagram illustrating a second example multi-band antenna system incorporating a bypass switch.

Consider the second example multi-band antenna system incorporating a bypass switch shown in FIG. 13. The circuit, generally referenced 240, comprises an antenna element (242) (e.g., chip antenna), PIN diode 244 electrically coupled to the antenna element, tuning circuit and L-Band receiver 242, tuning circuit 243 connected to the antenna element and UHF receiver 256. The tuning circuit 243 comprises impedances Z1 246, Z2 248, Z3 250 and PIN diodes 252, 254.

As in the circuit of FIG. 12, the actual tuning circuit employed in circuit 240 is not critical to the invention. It is noted that the particular frequency bands and related receivers (i.e. L-band and UHF) described herein are presented for illustration purposes only. It is appreciated that other frequency bands and receivers are contemplated to be used to construct the multi-band antenna system of the invention.

The antenna element may be constructed to resonate at any desired frequency. Several example frequencies include television broadcasting at 1.45 GHz, GPS at 1575.42 MHz and the 820-960 MHz band which supports a variety of radio communication services, such as cellular service, trunked land mobile service, low capacity and wideband fixed services and radiolocation services.

In this example, the antenna element is designed to resonate in the L-band (i.e. approximately 1.45 GHz), which is the frequency used for digital television broadcasting. The tuning circuit is designed to push the antenna resonant frequency down to the UHF band (i.e. approximately 470-860 MHz), which is also used for digital television broadcasting. The bypass switch in this example is the PIN diode 244 which is switched into one of two states. When the PIN diode 244 is zero or reverse biased, the L-band receiver 242 is effectively disconnected from the antenna element 242 and the frequency of the antenna system is determined by the tuning circuit 243. When the PIN diode 244 is forward biased, the L-band receiver 242 is electrically coupled to the antenna element and the frequency is determined by the natural resonant frequency of the antenna element. Thus, the antenna system functions as a multi-band antenna with the typical length of an L-band antenna, providing a small form factor, that also covers the UHF frequency band.

Note that if Z1 is set to be inductive, its impedance will increase as the frequency increases. This allows Z1 to be used as a block for the higher frequency (i.e. L-band frequency) when the bypass PIN diode 244 is conductive. Note also that for clarity, the DC biasing circuitry required to drive the PIN diodes is not shown.

Figure 14:
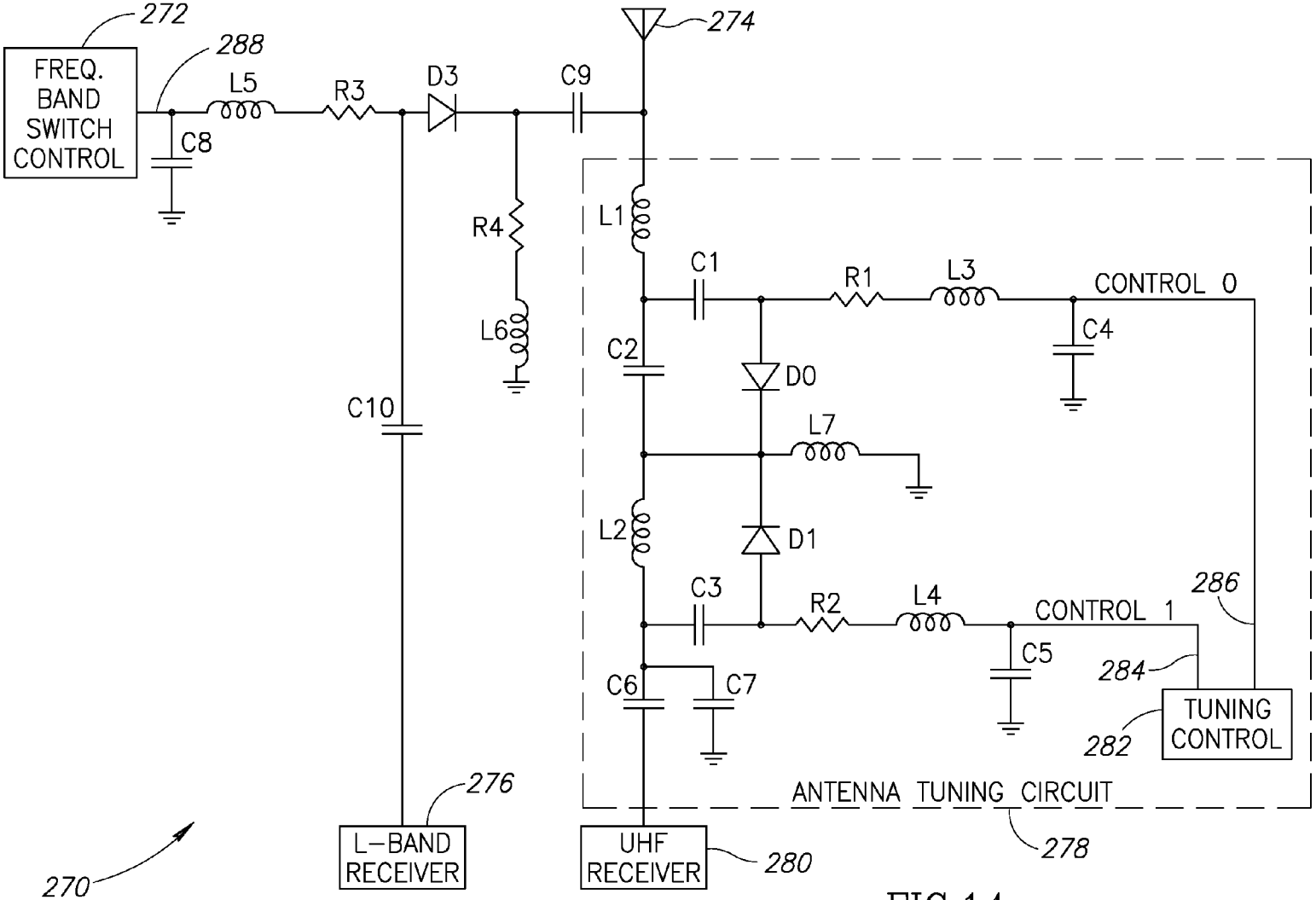
FIG. 14 is a block diagram illustrating a third example multi-band antenna system incorporating a bypass switch.

A block diagram illustrating a third example multi-band antenna system incorporating a bypass switch is shown in FIG. 14. The circuit, generally referenced 270, comprises an antenna element 274 (e.g., chip antenna), tuning circuit 278, UHF receiver 280, bypass circuitry D3, R3, R4, L5, L6, C8, C9, frequency band switch control 272 and L-band receiver 276 coupled via DC blocking capacitor C10. The tuning circuit 278 comprises PIN diodes D0, D1, inductors L1, L2, L3, L4, L7, capacitors C1, C2, C3, C4, C5, C6, C7, resistors R1, R2 and tuning control block 282.

In the circuit 270, which is used for both transmit and receive operations, the PIN diodes D0, D1, D3 are DC switched on (i.e. forward biased) and off (i.e. zero or reverse biased) so as to function as RF switches that can be opened and closed. To switch frequency bands, a DC bias voltage 288 is applied to the series inductor L5. This bias voltage is prevented from leaking back to the antenna element 274 via blocking capacitor C9. Forwarding biasing D3 electrically connects the antenna element 274 to the L-band receiver 276.

The tuning circuit 278 operates similarly to the first and second example tuning circuits described supra and thus will not be described in detail. In general, the tuning control circuit 282 provides the bias voltages CONTROL0 (286) and CONTROL1 (284) to effectively turn PIN diodes D0, D1, respectively, on and off, thereby changing the reactance coupled to the antenna element which effectively changing the tuning frequency of the antenna.

The tuning circuit 278 utilizes switched PIN diodes to realize a tuning circuit comprising a set of reactances connected in series. The array of PIN diodes short circuits each reactance individually via control signals CONTROL0 (286), CONTROL1 (284). By short circuiting each reactance, a different total reactance is generated which will directly impact the tuning frequency.

Note that Z1 is chosen to be inductive (i.e. an inductor). This allows the impedance of Z1 to go up with frequency. At L-band frequencies, the impedance of Z1 is so high that almost all of the energy developed by the antenna element goes through the PIN diode D3 to reach the L-band receiver. Virtually no energy is lost toward the UHF receiver.

Ceramic Dielectric Formulation

The antenna system described herein provides a ceramic formulation that when sintered into a ceramic substrate provides a material with high dielectric constant (>200) and low losses (<0.00060@1 MHz). When combined with tuner circuit elements this substrate is an effective broad band UHF antenna. Furthermore, unlike the $Ag(Nb,Ta)O_3$ system described in PCT published patent application WO9803446, incorporated herein by reference in its entirety, the invention herein does not require special atmosphere control during sintering nor does it use expensive metals such as silver, niobium or tantalum.

Following an extensive investigation of ceramic formulations in the $SrTiO_3$—$BaTiO_3$—$CaTiO_3$ system a range of formulations was identified with the correct combination of properties for UHF broadband antennas. The compositions investigated are described in Table 2 below.

TABLE 2

| Ceramic Compositions | | | | | |
|---|---|---|---|---|---|
| Component | A wt % | B Wt % | C wt % | D wt % | E wt % |
| Strontium titanate | 56.83 | 66.80 | 63.43 | 60.15 | 70.12 |
| Barium titanate | 28.42 | 7.11 | 14.21 | 21.32 | 0 |
| Calcium titanate | 4.73 | 23.59 | 17.31 | 11.02 | 29.88 |
| Calcium zirconate | 4.73 | 1.18 | 2.37 | 3.55 | 0 |
| Bismuth trioxide | 2.05 | 0.50 | 1.03 | 1.54 | 0 |
| Zirconia | 0.79 | 0.20 | 0.40 | 0.59 | 0 |
| Manganese dioxide | 0.09 | 0.02 | 0.05 | 0.07 | 0 |
| Zinc oxide | 0.47 | 0.12 | 0.24 | 0.35 | 0 |
| Lead free Glass frit | 0.47 | 0.12 | 0.24 | 0.35 | 0 |
| Kaolin (Clay) | 0.95 | 0.24 | 0.48 | 0.71 | 0 |
| Cerium oxide | 0.47 | 0.12 | 0.24 | 0.35 | 0 |

These ceramic compositions were formulated into ceramic slips and cast into substrates by methods well known in the art. After removal of organics in a bakeout process the final sintering was performed in air at temperatures 1270° C. and 1250° C. respectively, although other temperatures may be used. The dielectric properties were measured at 1 MHz and are shown in Table 3 below.

TABLE 3

| Dielectric Properties at 1 MHz | | | | | | |
|---|---|---|---|---|---|---|
| | Firing Temperature 1270° C. | | Firing Temperature 1250° C. | | TCC, ppm/° C. | |
| Composition | K | DF | K | DF | @−40 to 20° C. | @20 to 85° C. |
| A | 680 | 0.00059 | 680 | 0.00059 | ~−12000 | −5000 |
| B | 560.9 | 0.00036 | 560 | 0.00024 | −9300 | −4500 |
| C | 406.9 | 0.00042 | 407 | 0.00036 | −6600 | −3100 |
| D | 333.5 | 0.00046 | 328 | 0.00038 | −3900 | −2150 |
| E | 250 | 0.00032 | 250 | 0.00032 | −1200 | −1200 |

The dielectric constant (K) is very similar for the two different firing temperatures and there is a small variation in dielectric losses (DF). The temperature coefficient of capacitance (TCC) is similar for both firing temperatures. It is important to note that TCC for these compositions is very high compared to a Class 1 C0G multilayer capacitor formulation (+/−30 ppm/° C. in the temperature range −55° C. to +125° C.) or a narrow band microwave antennas. In the case of the multilayer capacitor or narrow band microwave antenna stable properties with temperature are required to prevent a drift out of specification with temperature fluctuations. However, since these ceramics are used in a UHF antenna over a broad frequency band, temperature stability is less critical so higher TCC can be tolerated.

Figure 15:
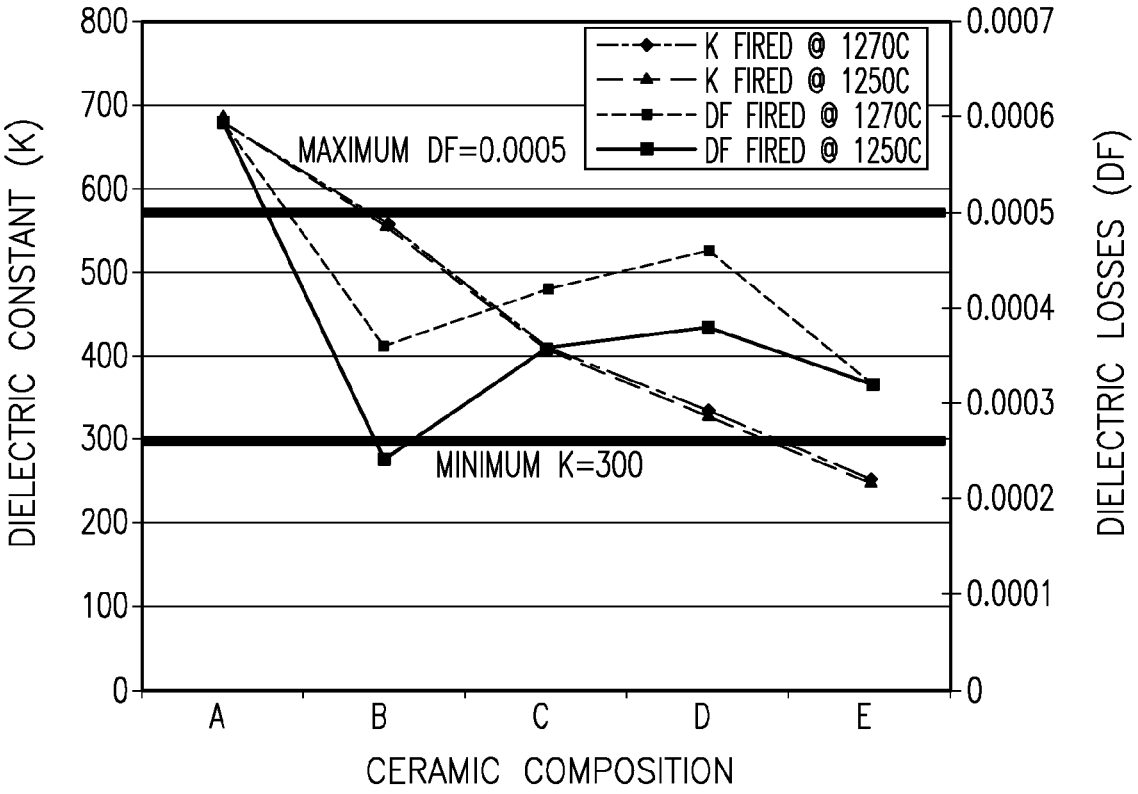
FIG. 15 is a chart illustrating dielectric constants and dielectric losses for several examples of dielectric ceramic material.

In order to form miniaturize the antenna whilst retaining low losses dielectric constant has to be maximized while retaining low losses. A chart illustrating dielectric constants and DF for the examples provided is shown in FIG. 15. By plotting the dielectric constants and DF reported in Table 3 it can be seen that only for dielectric formulations B, C and D is the dielectric constant above 300 with DF below 0.0005.

Figure 16:
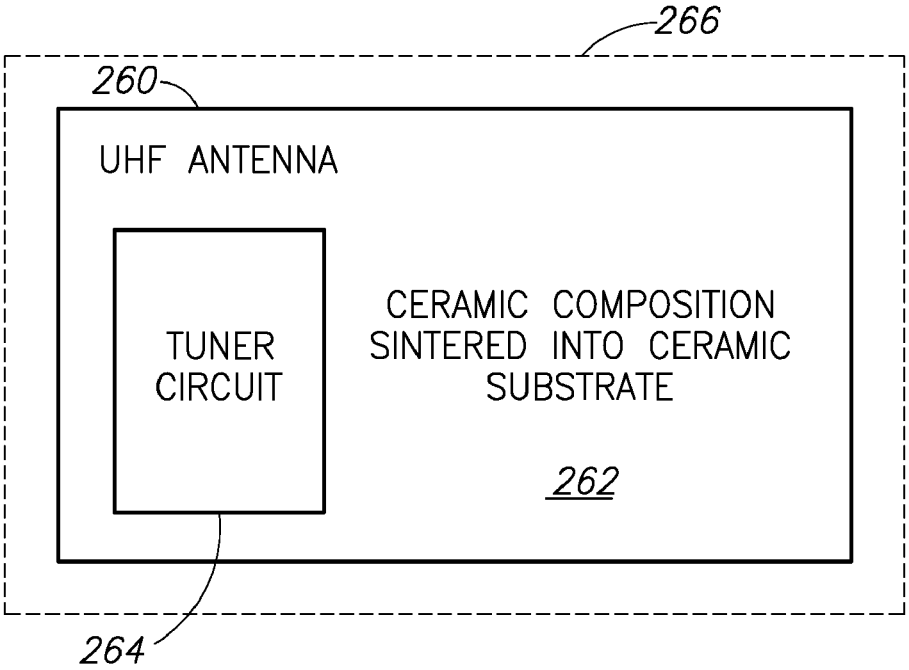
FIG. 16 is a block diagram illustrating a first example embodiment of a UHF antenna formed with a ceramic dielectric formulation.

A pictorial representation of a first example embodiment of a UHF (or VHF) antenna formed with a ceramic dielectric formulation is shown in FIG. 16. The UHF antenna, generally referenced 260, comprises a ceramic composition sintered into a ceramic substrate 262, such as that described supra. The UHF antenna 260 further comprises tuner circuit 264. The UHF antenna 260 may then be incorporated into an electronic device 266 such as the mobile station 70 described infra.

Figure 17:
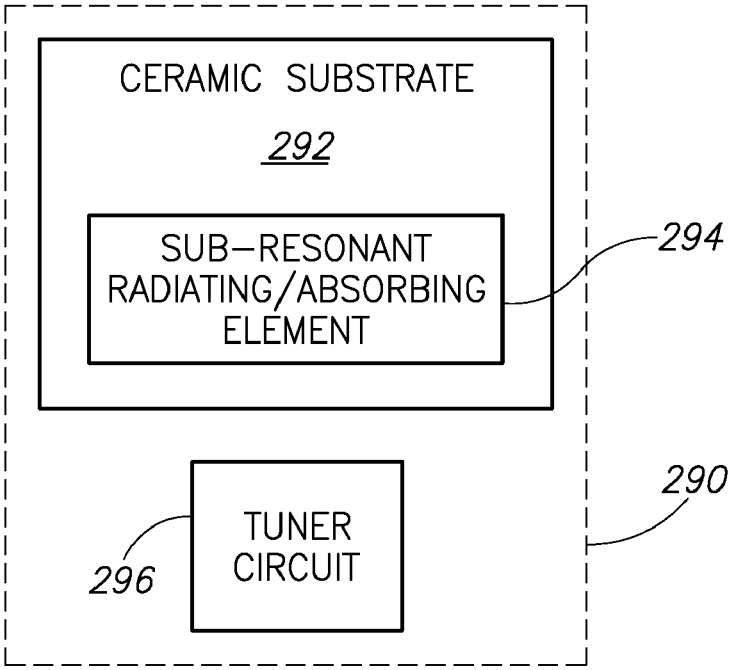
FIG. 17 is a block diagram illustrating a second example embodiment of a UHF antenna formed with a ceramic dielectric formulation.

A block diagram illustrating a second example embodiment of a UHF (or VHF) antenna formed with a ceramic dielectric formulation is shown in FIG. 17. In this second embodiment, the UHF antenna, generally referenced 290, comprises a ceramic composition sintered into a ceramic substrate 292, such as that described supra, on which the sub-resonant radiating/absorbing element is constructed. The UHF antenna 290 further comprises tuner circuit 296 constructed off the ceramic substrate such as on a PCB assembly. It is noted that the tuning circuit 296 is constructed independently of the antenna and any coupled receiver/transmitter and does not necessarily need to be disposed on the ceramic substrate 292 as in FIG. 16 where it is part of the dielectric loading. The tuning circuit may (1) comprise discrete components located on a PCB, (2) be part of a system on a chip (SoC) design, (3) be part of a hybrid design, etc. The UHF antenna 290 may be incorporated into an electronic device such as the mobile station 70 described infra.

Note that the dielectric ceramic material may be used for other purposes in addition to use in UHF or VHF antennas. It may be used in dielectric resonators, filters, substrates for microelectronic circuits, or built-in to any number of types of electronic devices.

Mobile Station Incorporating the Single or Multi-Band Antenna System

Figure 18:
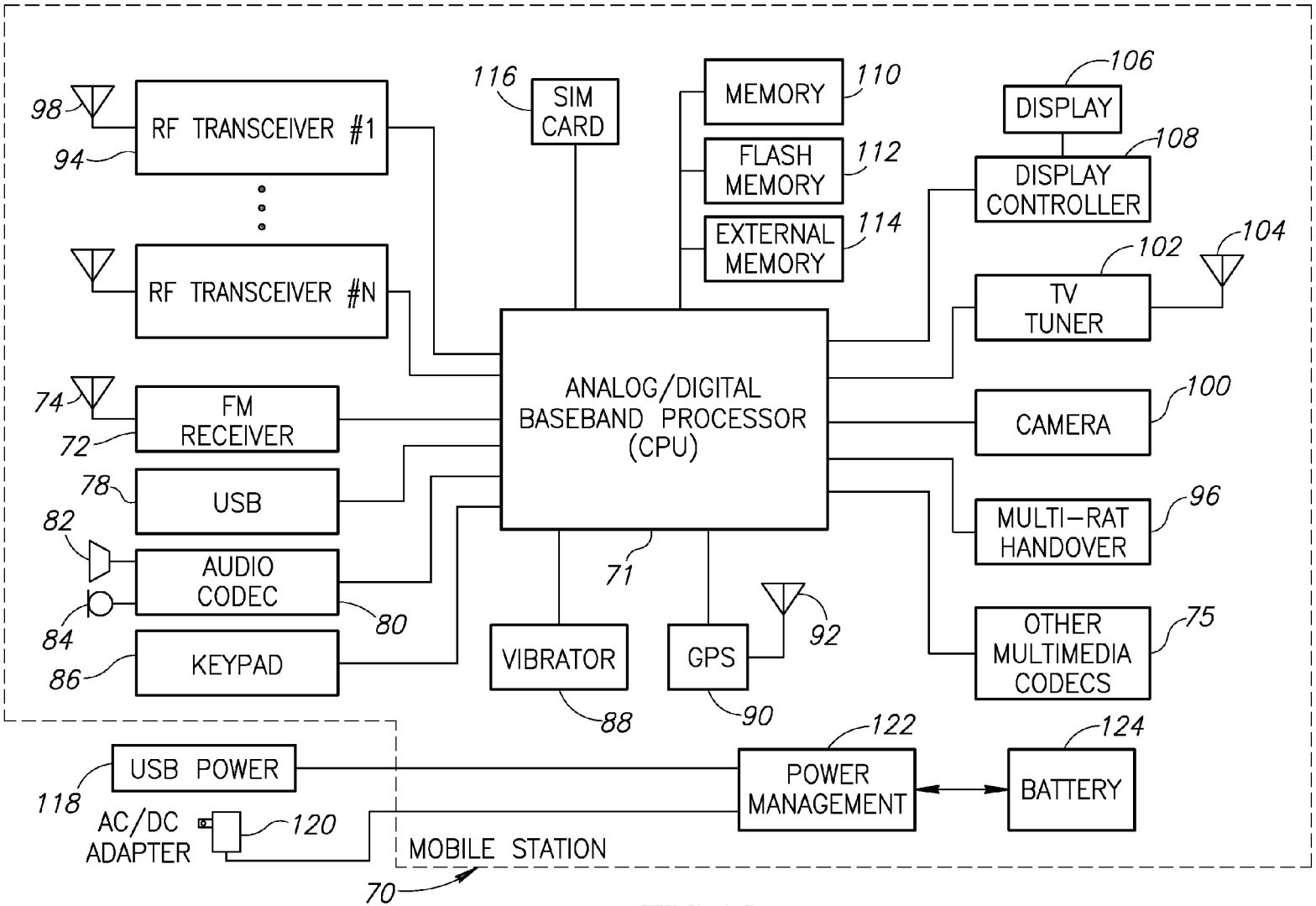
FIG. 18 is a block diagram illustrating a mobile station incorporating the multi-band antenna system of the present invention.

A block diagram illustrating an example mobile device incorporating the multi-band antenna system of the present invention is shown in FIG. 18. Note that the mobile station may comprise any suitable wired or wireless device such as a multimedia player, mobile communication device, cellular phone, smartphone, PDA, Bluetooth device, etc. For illustration purposes only, the device is shown as a mobile station. Note that this example is not intended to limit the scope of the invention as the multi-band antenna of the present invention can be implemented in a wide variety of communication devices.

The mobile station, generally referenced 70, comprises a baseband processor or CPU 71 having analog and digital portions. The MS may comprise a plurality of RF transceivers 94 and associated antennas 98. RF transceivers for the basic cellular link and any number of other wireless standards and RATs may be included. Examples include, but are not limited to, Global System for Mobile Communication (GSM)/GPRS/

EDGE; 3G; LTE; CDMA; WiMAX for providing WiMAX wireless connectivity when within the range of a WiMAX wireless network; Bluetooth for providing Bluetooth wireless connectivity when within the range of a Bluetooth wireless network; WLAN for providing wireless connectivity when in a hot spot or within the range of an ad hoc, infrastructure or mesh based wireless LAN network; near field communications; 60G device; UWB; etc. One or more of the RF transceivers may comprise an additional a plurality of antennas to provide antenna diversity which yields improved radio performance. The mobile station may also comprise internal RAM and ROM memory 110, Flash memory 112 and external memory 114.

Several user interface devices include microphone(s) 84, speaker(s) 82 and associated audio codec 80 or other multimedia codecs 75, a keypad for entering dialing digits 86, vibrator 88 for alerting a user, camera and related circuitry 100, a TV tuner 102 and associated antenna 104, display(s) 106 and associated display controller 108 and GPS receiver 90 and associated antenna 92. Note that the TV tuner may be constructed to implement one or more digital television broadcasting standards, such as DVB-T, DVB-H, etc. A USB or other interface connection 78 (e.g., SPI, SDIO, PCI, etc.) provides a serial link to a user's PC or other device. An FM receiver 72 and antenna 74 provide the user the ability to listen to FM broadcasts. SIM card 116 provides the interface to a user's SIM card for storing user data such as address book entries, etc. The mobile station comprises a multi-RAT handover block 96 which may be executed as a task on the baseband processor 71.

Portable power is provided by the battery 124 coupled to power management circuitry 122. External power is provided via USB power 118 or an AC/DC adapter 120 connected to the battery management circuitry which is operative to manage the charging and discharging of the battery 124.

In accordance with the invention, any or all of the antennas in the mobile station, including RF transceiver antennas 98, FM receiver antenna 74, GPS antenna 92 and TV tuner antenna 104 may comprise the single band or multi-band antenna system of the present invention, described in detail supra.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. As numerous modifications and changes will readily occur to those skilled in the art, it is intended that the invention not be limited to the limited number of embodiments described herein. Accordingly, it will be appreciated that all suitable variations, modifications and equivalents may be resorted to, falling within the spirit and scope of the present invention. The embodiments were chosen and described in order to best explain the principles of the invention and the practical application, and to enable others of ordinary skill in the art to understand the invention for various embodiments with various modifications as are suited to the particular use contemplated.

What is claimed is:

1. An antenna providing a tunable range in a desired frequency band, comprising:

an antenna element, said antenna element comprising:

a substrate made of a dielectric ceramic material containing at least strontium titanate, barium titanate and calcium titanate components;

a radiating structure disposed on said substrate, wherein said dielectric ceramic material provides dielectric loading of said radiating structure;

wherein said antenna element is intentionally loaded and tuned to a frequency significantly higher than said desired frequency band;

a variable reactance tuning circuit electrically coupled to said antenna element, said tuning circuit operative to lower the resonant frequency of said antenna element to a frequency within said desired frequency band.

2. The antenna according to claim 1, wherein said radiating structure comprises planar conductive element.

3. The antenna according to claim 1, wherein said antenna element comprises a ceramic chip antenna.

4. The antenna according to claim 1, wherein said substrate comprises a ceramic substrate with a dielectric constant higher than 100.

5. The antenna according to claim 1, wherein said resonant frequency is approximately 1 GHz.

6. The antenna according to claim 1, wherein said desired frequency band comprises frequencies in the Ultra High Frequency (UHF) band.

7. The antenna according to claim 1, wherein said desired frequency band comprises frequencies between approximately 470 MHz and 860 MHz.

8. The antenna according to claim 1, wherein said desired frequency band comprises frequencies in the Very High Frequency (VHF) band.

9. The antenna according to claim 1, wherein said desired frequency band comprises frequencies between approximately 200 MHz and 300 MHz.

10. The antenna according to claim 1, wherein said tuning circuit comprises a wideband tuning circuit for compensating the intentionally mistuned antenna element.

11. The antenna according to claim 1, wherein said tuning circuit comprises one or more series and/or parallel combinations of reactive elements.

12. The antenna according to claim 11, wherein said antenna element resonates at a higher frequency than desired while exhibiting a desired impedance within said desired frequency band determined by said series and/or parallel combinations of reactive elements.

13. The antenna according to claim 1, wherein said antenna element at a higher frequency than desired while exhibiting a real impedance of approximately 50 ohm within said desired frequency band.

14. The antenna according to claim 1, wherein said antenna element having an imaginary impedance that is negated via said tuning circuit.

15. The antenna according to claim 1, wherein the size of said antenna element is too small for it to radiate naturally in said desired frequency band.

16. A method of designing an antenna tunable over a desired frequency band, said method comprising:

providing an antenna element comprising a radiating structure disposed on a substrate made of a dielectric material containing at least strontium titanate, barium titanate and calcium titanate components, said antenna element operative to provide dielectric loading of said radiating structure, wherein said antenna element is intentionally loaded and tuned to a frequency significantly higher than said desired frequency band;

compensating for said mistuned antenna element by providing a variable reactance tuning circuit electrically coupled to said antenna element to tune said antenna element to a frequency within said desired frequency band.

17. The method according to claim 16, wherein said desired frequency band comprises frequencies between approximately 470 MHz and 860 MHz in the Ultra High Frequency (UHF) band.

18. The method according to claim 16, wherein said desired frequency band comprises frequencies between approximately 200 MHz and 300 MHz in the Very High Frequency (VHF) band.

19. The method according to claim 16, wherein said antenna element resonates at a substantially higher frequency than desired while exhibiting a real impedance of approximately 50 Ohms within said desired frequency band.

20. A multi-band antenna, comprising:

an antenna element comprising a radiating structure disposed on a substrate made of a dielectric material containing at least strontium titanate, barium titanate and calcium titanate components, said antenna element providing dielectric loading of said radiating structure, wherein the antenna element is intentionally adapted to resonate at a first frequency in a high frequency band, said first frequency significantly higher than desired;

a variable reactance tuning circuit electrically coupled to said antenna element, said tuning circuit operative to lower the resonant frequency of said antenna element to a second frequency in a low frequency band; and a switch electrically coupled to said antenna element and said tuning circuit, said switch operative to bypass said tuning circuit thereby permitting said antenna element to resonate at said first frequency in said high frequency band.

21. The multi-band antenna according to claim 20, wherein said low frequency band comprises frequencies between approximately 470 MHz and 860 MHz in the Ultra High Frequency (UHF) band.

22. The multi-band antenna according to claim 20, wherein said low frequency band comprises frequencies between approximately 200 MHz and 300 MHz in the Very High Frequency (VHF) band.

23. The multi-band antenna according to claim 20, wherein said high frequency band comprises frequencies in the L-band.

24. The multi-band antenna according to claim 20, wherein said first frequency is approximately 1.45 GHz in the L frequency band.

25. The multi-band antenna according to claim 20, wherein said switch comprises a PIN diode.

26. A method of designing a multi-band antenna, said method comprising the steps of:

providing an antenna element comprising a radiating structure disposed on a substrate made of a dielectric material containing at least strontium titanate, barium titanate and calcium titanate components, said antenna element operative to provide dielectric loading of said radiating structure, wherein said antenna element is intentionally loaded and tuned to a frequency significantly higher than said desired frequency band;

compensating for said mistuned antenna element by providing a variable reactance tuning circuit electrically coupled to said antenna element to lower the resonate frequency of said antenna element to a frequency in a low frequency band; and providing a switch electrically connected to said antenna element and said tuning circuit, said switch operative to bypass said tuning circuit thereby allowing said antenna element to resonate at said resonant frequency in said high frequency band.

27. The method according to claim 26, wherein said low frequency band comprises frequencies between approximately 470 MHz and 860 MHz in the Ultra High Frequency (UHF) band.

28. The method according to claim 26, wherein said low frequency band comprises frequencies between approximately 200 MHz and 300 MHz in the Very High Frequency (VHF) band.

29. The method according to claim 26, wherein said high frequency band comprises frequencies in the L-band.

30. The method according to claim 26, wherein said first frequency is approximately 1.45 GHz.

31. The method according to claim 26, wherein said switch comprises a PIN diode.

32. An antenna providing a tunable range in a desired frequency band, comprising:

an antenna element comprising a radiating structure disposed on a substrate made of a dielectric material containing at least strontium titanate, barium titanate and calcium titanate components, said antenna element providing dielectric loading of said radiating structure, wherein said antenna element is intentionally loaded and tuned such that its resonant frequency is at the upper end of said desired band of frequencies; and a variable reactance tuning circuit electrically coupled to said antenna element, said tuning circuit operative to lower the resonant frequency of said antenna element to a frequency lower than said resonant frequency.

33. A mobile communications device, comprising:

a transceiver operative to receive and transmit transmissions to and from a base station;

a second radio operative to receive a signal in a desired frequency band from an antenna system electrically coupled thereto, said antenna system comprising:

an antenna element comprising a radiating structure disposed on a substrate made of a dielectric material containing at least strontium titanate, barium titanate and calcium titanate components, said antenna element providing dielectric loading of said radiating structure, wherein said antenna element is intentionally loaded and tuned such that its resonant frequency is substantially higher than said desired band of frequencies;

a variable reactance tuning circuit electrically coupled to said antenna element, said tuning circuit operative to lower the resonant frequency of said antenna element to a frequency within said desired frequency band; and a processor operative to receive data from said second radio and to send and receive data to and from said transceiver.

34. The mobile communications device according to claim 33, wherein said desired frequency band comprises frequencies between approximately 470 MHz and 860 MHz in the Ultra High Frequency (UHF) band.

35. The mobile communications device according to claim 33, wherein said desired frequency band comprises frequencies between approximately 200 MHz and 300 MHz in the Very High Frequency (VHF) band.

36. The mobile communications device according to claim 33, further comprising a switch electrically coupled to said antenna element and said tuning circuit, said switch operative to bypass said tuning circuit thereby permitting said antenna element to resonate at said resonant frequency substantially higher than said desired band of frequencies.

37. The mobile communications device according to claim 36, wherein said resonant frequency comprises frequencies in the L-band.

38. The mobile communications device according to claim 36, wherein said resonant frequency is approximately 1.45 GHz.

39. An antenna system, comprising:

an antenna element having a radiating structure disposed on a dielectric material substrate containing at least strontium titanate, barium titanate and calcium titanate components, said antenna element intentionally loaded and tuned such that its resonant frequency is significantly higher than a desired frequency band, wherein the size of said antenna element is too small for it to radiate naturally in said desired frequency band; and a tuning circuit electrically coupled to said antenna element and operative to compensate for a frequency offset of said antenna element thereby shifting the resonant frequency of said antenna element to a desired lower frequency band.

40. The antenna system according to claim 39, wherein said antenna element is constructed on a substrate comprising a dielectric ceramic composition.

41. The antenna system according to claim 39, wherein said desired frequency band comprises frequencies between approximately 470 MHz and 860 MHz in the Ultra High Frequency (UHF) band.

42. The antenna system according to claim 39, wherein said desired frequency band comprises frequencies between approximately 200 MHz and 300 MHz in the Very High Frequency (VHF) band.

43. The antenna system according to claim 39, further comprising a bypass switch electrically coupled to said antenna element and said tuning circuit, said bypass switch operative to bypass said tuning circuit thereby permitting said antenna element to resonate at said higher first frequency.

44. The antenna system according to claim 43, wherein said bypass switch comprises a PIN diode.

* * * * *